US005191861A

United States Patent [19]

Kellerman et al.

[11] Patent Number: 5,191,861

[45] Date of Patent: Mar. 9, 1993

[54] INTERNAL COMBUSTION ACTUATED PORTABLE TOOL

[75] Inventors: Rudolph J. Kellerman, North Kingstown; Arthur E. Perra, Hope Valley; Leo E. La Barre, West Warwick; Walter G. Lemos, North Smithfield, all of R.I.

[73] Assignee: Stanley-Bostitch, Inc., East Greenwich, R.I.

[21] Appl. No.: 729,194

[22] Filed: Jul. 12, 1991

[51] Int. Cl.[5] ..... F02B 75/04; F02B 21/04; F02B 71/04; B25C 1/08

[52] U.S. Cl. ..... 123/46 SC; 227/10

[58] Field of Search ..... 123/46 R, 46 E, 46 H, 123/46 SC; 227/9, 10

[56] References Cited

U.S. PATENT DOCUMENTS

| | | | |
|---|---|---|---|
| 2,898,893 | 8/1959 | Rohrer | 227/8 |
| 3,042,008 | 7/1962 | Liesse | 123/46 SC |
| 4,200,213 | 4/1980 | Liesse | 123/46 SC |
| 4,365,471 | 12/1982 | Adams | 60/39.76 |
| 4,377,991 | 3/1983 | Liesse | 123/46 SC |
| 4,403,722 | 9/1983 | Nikolich | 227/8 |
| 4,480,611 | 11/1984 | Wendt | 123/46 SC |
| 4,483,280 | 11/1984 | Nikolich | 123/46 SC |
| 4,483,473 | 11/1984 | Wagdy | 227/8 |
| 4,483,474 | 11/1984 | Nikolich | 123/46 SC |
| 4,522,162 | 6/1985 | Nikolich | 123/46 SC |
| 4,665,868 | 5/1987 | Adams | 123/46 SC |
| 4,739,915 | 4/1988 | Cotta | 123/46 SC |
| 4,773,581 | 9/1988 | Ohtsu et al. | 123/46 SC |
| 4,821,683 | 4/1989 | Veldman | 123/46 SC |
| 5,090,606 | 2/1992 | Torii et al. | 123/46 SC |

*Primary Examiner*—Willis R. Wolfe

*Attorney, Agent, or Firm*—Cushman, Darby & Cushman

[57] ABSTRACT

An internal combustion actuated fastener driving device in which a simple container supply of fuel under pressure carried in a handle portion of the portable housing assembly feeds to a supply chamber controlled by an actuating valve operable in response to a manual acuating procedure to be spring moved into an operative position. The movement of the actuating valve into its operative position communicates a previously formed charge of gaseous fuel under pressure in a separate charge chamber with a series of nozzles so as to discharge in jet stream formations which aspirate fresh air through inlets to mix therewith in a mixing chamber for passage into a combustion chamber in open condition controlled by a main valve. The main valve moves under spring bias into a closed position in response to the depletion of gaseous fuel pressure within the charge chamber in timed relation with the crowding of the spent gases from the combustion chamber by the new combustible mixture. Ignition is in response to the closing of the main valve by a piezoelectric unit. The piston is driven by the energy of the combustion of mixture which initially is at generally atmospheric pressure. The return stroke of the piston is effected by a spring system which is active only at the end of the drive stroke and beginning of the return stroke.

69 Claims, 6 Drawing Sheets

INTERNAL COMBUSTION ACTUATED PORTABLE TOOL

The invention relates to portable tools and, more particularly, to internal combustion actuated portable tools of the one-cycle type.

Internal combustion actuated portable tools of the one-cycle type have been proposed in the patented literature as early as 1959, see U.S. Pat. No. 2,898,893. See also U.S. Pat. No. 3,042,008, which specifically discloses an internal combustion actuated fastener driving device. Despite the existence of fastener driving devices of this type for an extended number of years in the patented literature, significant marketing of devices of this type has not been forthcoming until recent years. All of the devices proposed in the earlier prior art years have undertaken to more or less duplicate on a single cycle basis the conventional cycle utilized in internal combustion engines. That is, the cycle included replacing the spent gases in the combustion chamber with a charge of combustible gases, placing the combustible gas under an initial pressure, igniting the pressurized charge to effect driving of the piston within the cylinder and, hence, the fastener driver to drive the fastener fed to the drive track by the fastener magazine assembly. The cycle also included a return movement of the piston.

It has long been known that a major advantage which internal combustion actuated fastener driving devices could achieve in comparison with the commercially acceptable pneumatically actuated fastener driving devices resides in the fact that, in order to operate an internal combustion actuated device, it was not necessary to have available equipment capable of generating a source of air under pressure. This advantage is particularly desirable in new building construction use where a source of air under pressure is not readily available and must be provided by a portable engine and pump-accumulator assembly. Despite this known advantage, marketing of an internal combustion actuated fastener driving device which would secure this basic advantage has not been forthcoming based upon the prior art devices disclosing a cycle which follows on a one-cycle basis essentially the same cycle of operation which is repetitively carried out in internal combustion engines. Specifically, in the early patents, provision was made in the operating cycle for initially pressurizing the charge of combustible gases prior to ignition. In recent years, there have been a number of patents disclosing operating cycles which eliminate the step of pressurizing the charge. Instead, the charge is ignited essentially at atmospheric pressure conditions. In retrospect, it can be seen that the conceived need to pressure the charge prior to ignition was a required function which inherently rendered the device incapable of rapid fastener driving response to the initial manual actuating procedure. Even without the requirement to pressurize the charge, in order to achieve rapid response it is still necessary to establish a new charge in the combustion chamber in a condition to be ignited before the driving movement can be accomplished. Establishing a new charge involves getting fuel and air mixed and into the combustion chamber. Moreover, elimination of the pressurization step just before ignition eliminates the inherent turbulation of the charge at the time of ignition provided by the pressurization step.

As previously indicated, the patented literature discloses several different approaches toward getting fuel and air mixed and into the combustion chamber so that the mixture can be ignited while generally at atmospheric pressure conditions. The earliest of these patents, namely, U.S. Pat. No. 4,365,471, discloses an arrangement in which the fuel and air are mixed and disposed in the combustion chamber during the last portion of each cycle. This leaves as the only function required to be performed at the beginning of each cycle, in order to initiate the drive stroke, the function of igniting the existing charge. This arrangement makes the drive stroke virtually instantaneously responsive to trigger actuation but presents the charge to be ignited in an essentially non-turbulent condition. The patent discloses a specific manner of accomplishing an ignition and detonation of the mixed charge within the combustion chamber which does not require the mixture to be turbulent at the time of ignition. The specific manner in which the air and fuel are mixed and disposed in the combustion chamber is to feed a charge of air and fuel into a separate filling chamber as it is expanded in volume by positive displacement during a mid-portion of each cycle. Thereafter, during a final portion of each cycle, the filling chamber with the mixture therein is contracted in volume by positive displacement to pump the mixture into the combustion chamber. The arrangement is such that the movement of the mixture into the combustion chamber is utilized to displace the spent gases contained in the combustion chamber outwardly through an opened exhaust valve which is closed at the end of the positive displacement. The specific manner of achieving efficient combustion of the ignited non-turbulent mixture is to separate the combustion chamber into a remote relatively small ignition chamber and an adjacent relatively large detonation chamber in direct communicating relation with the drive chamber. The communication between the ignition chamber and the detonation chamber is along the periphery of the detonation chamber so that the burning of the charge in the ignition chamber will result in flames passing into the periphery of the detonation chamber so as to combust the charge in the detonation chamber with an inward detonation action.

The power tool disclosed in the patent for driving fasteners is illustrated in a more or less schematic fashion. A more specifically developed structural arrangement is disclosed in related U.S. Pat. No. 4,665,868. The earlier schematic arrangement disclosed a device in which the height of the tool increases to an excessive amount during each operating cycle when the filling chamber reaches its fully expanded condition. The later patent builds this excessive height into the tool as a permanent part of the housing. The earlier arrangement is probably too dangerous while the latter is too tall for a marketable tool.

The arrangement disclosed in U.S. Pat. No. 4,377,991 is similar to that disclosed in the patents noted above except that there is a trade off of response time in order to achieve ignition and burning while the mixture is turbulent within the combustion chamber. Essentially, this patent discloses a similar separate filling chamber, the transfer mechanism for which adds excessive height to the tool housing. The filling chamber is filled with a charge of fuel and air at the end of the cycle. At the beginning of the cycle, the transfer mechanism is operated to transfer the mixture from the filling chamber to the combustion chamber in a manner establishing turbulence in the mixture just before ignition takes place. Thus, there is a comparative undesirable increase in the response time, the necessity to provide for the effective combustion of an essentially non-turbulent charge is eliminated but a high profile housing is provided.

There is included in the prior art a number of related patents disclosing devices of the type herein contemplated which provide a sufficiently low housing height size or profile to be marketable. These related U.S. patents include U.S. Pat. Nos. 4,403,722, 4,483,280, 4,483,473, 4,483,474, and 4,522,162. The essence of all of these related arrangements is to provide an electric fan in the combustion chamber so that the vertical height of the tool is increased beyond the height required to stack an atmospheric combustion chamber over the drive piston chamber only to the extent required to accommodate the fan, the blade of which is in the combustion chamber. The electric fan is essentially operated at all times thus requiring a short-life rechargeable battery pack to keep it running. Thus, the disadvantage is that the operator must pay for and deal with rechargeable battery packs, as well as replaceable fuel packs, in order to achieve both a fast response time and a turbulent charge within a relatively low profile tool. The fan is used to replace the spent gases within the combustion chamber with fresh air toward the end of the cycle. This leaves only the function of introducing the fuel into the combustion chamber so as to be mixed and turbulated with the fresh air therein by the fan before ignition takes place.

The arrangement for introducing the fuel into the combustion chamber includes a mechanism for measuring a charge of liquid fuel under pressure from a supply and then communicating the measured liquid charge with the combustion chamber so that its pressure results in the charge flashing into a gas as it enters the combustion chamber, thus materially reducing the time required to introduce the fuel and materially increasing the mixing characteristics with the air in the combustion chamber. However, the necessity to measure the charge as a liquid requires that the liquid supply of fuel under pressure be maintained above a predetermined level. The need to keep the liquid supply under a minimum pressure materially increases the packaging costs for the fuel supply. Since a given supply will only operate the tool through a given number of cycles, fuel supply costs determine the operating cost per fastener. These costs must exceed as little as possible the costs of running the pressurized air producing equipment in order to make the saving of initial equipment costs worthwhile.

The various arrangements disclosed in U.S. Pat. No. 4,821,683 are similar to that of U.S. Pat. No. 4,377,991 in that the cycle is initiated by transferring a mixture of fuel and air into the combustion chamber. The disclosed structure for accomplishing the transfer includes a single compound trigger actuated valve which controls a unitary inlet/outlet for the combustion chamber and the flow of pressurized fuel through a nozzle from a source of fuel under pressure. The flow of fuel through the nozzle induces a flow of fresh air to mix with the fuel both of which pass together in a mixed state into the combustion chamber through the inlet side of the open inlet/outlet and move around the combustion chamber so as to cause the spent gases therein to be moved through the outlet side of the open inlet/outlet. While the structural arrangement is advantageously simple, there are offsetting disadvantages. More specifically, in all of the various arrangements except for the embodiment of FIGS. 14 and 15, the compound valve which is moved from its at rest position into an operating position to open the inlet/outlet and release the fuel under pressure must be moved back into its at rest position in order to stop the release of further pressurized fuel and to close the inlet/outlet before ignition can take place. In the structural arrangement shown which obtains the advantages of simplicity and low housing height size, the first movement is accomplished by a manual trigger actuation and the return movement is accomplished either by a manual trigger release or a further trigger actuating movement (FIG. 24). Ignition is triggered in response to the completion of the second movement. In essence, the initial manual trigger actuation is used to effect transfer and the subsequent trigger movement is used to abruptly halt the transfer and to initiate the cycle. Thus, the possibility exists that transfer of the fuel-air mixture once started can continue at the established velocity out through the outlet side of the open inlet/outlet into the surrounding atmosphere unless manually stopped. In the FIG. 14–15 embodiment, there is shown an arrangement in which a predetermined charge of fuel under pressure is communicated with the nozzle when the valve is moved into its open position. From the size of the chamber shown, it is most likely that the charge of fuel must be in liquid form similar to the arrangement of the devices which include the fan in the combustion chamber.

An object of the present invention is the provision of an internal combustion actuated portable tool of the type described which achieves substantially all of the advantages of the aforesaid prior art devices without suffering from the disadvantages thereof. In accordance with the principles of the present invention, this objective is achieved by providing an internal combustion actuated portable tool comprising a housing assembly including a workpiece engaging portion defining therein a fastener drive track, a main body portion adjacent the workpiece engaging portion defining an acceptable housing profile having a cylindrical drive chamber therein and a handle portion extending transversely from the main body portion for enabling a user to manually move the housing assembly in portable fashion. A drive piston is slidably sealingly mounted in the cylindrical drive chamber for movement through repetitive cycles each of which includes a drive stroke and a return stroke. A fastener driving element is operatively connected with the piston and mounted in the fastener drive track for movement therein through a drive stroke in response to the drive stroke of the piston and a return stroke in response to the return stroke of the piston. A magazine assembly is carried by the housing assembly for containing a supply of fasteners and feeding successive leading fasteners of the supply into the fastener drive track to be driven therefrom by the fastener driving element during the drive stroke thereof. A combustion chamber is disposed above the drive chamber within the acceptable profile defining portion of the housing assembly. An annular mixing chamber is disposed in surrounding relation with the cylindrical drive chamber and has a fresh air inlet communicating with a lower end thereof. A main valve assembly is movable between (1) an open position wherein the combustion chamber is open at a lower position of communication with the mixing chamber and at a spaced upper position of communication with the atmosphere and (2) a closed position wherein the combustion chamber is closed from communication with the mixing chamber and the atmosphere. A gaseous fuel chamber is disposed within the housing assembly in cooperating relation with a series of annularly spaced nozzles operable when a predetermined charge of gaseous fuel under pressure from the gaseous fuel chamber is communicated therewith to direct the charge into the mixing chamber in a series of jet stream formations with the combustion chamber open so that the jet stream formations are operable (1) to cause fresh air from the fresh air inlet to be entrained and mixed with the charge of fuel forming the jet stream formations and (2) to cause the jet stream formations of fuel mixed with entrained air to flow from the mixing chamber into the open combustion chamber and move sufficient residual gas in the combustion chamber therethrough and into the atmosphere to fill the combustion chamber with a charge of combustible gases in the form of an air-fuel mixture. The arrangement is such that in response to a predetermined manual actuating procedure (1) a predetermined charge of gaseous fuel under pressure within the gaseous fuel chamber supplied thereto from a source of fuel under pressure is caused to be communicated with the nozzle assembly so as to fill the combustion chamber with a charge of combustible gases, (2) the main valve is caused to be moved from the open position into said closed position in timed relation to the filling of the combustion chamber with the charge of combustible gases, and (3) the charge of combustible gases is ignited by an igniting assembly in the combustion chamber while the charge is at generally atmospheric pressure to create pressure conditions in the combustion chamber in communication with the drive chamber sufficient to drive the drive piston and the fastener driving element through a drive stroke.

Preferably, the internal combustion actuated fastener driving device of the present invention also includes several specific features including an improved fuel supply arrangement enabling each successive charge to be measured while in gaseous form thereby enabling a pressurized liquid fuel supply to be utilized within a simple container without the necessity of maintaining the liquid fuel supply within the supply container at a liquid maintaining pressure level as it is depleted by usage, an arrangement for initiating the movement of the main valve from the open position thereof in response to a predetermined diminished pressure of the charge of gaseous pressure communicated with the nozzles so as to coordinate the movement of the main valve into the closed position thereof with the movement of the new charge into the combustion chamber and simultaneous movement of the spent charge therefrom, a particular actuating arrangement including an actuating valve moved by spring movement into its actuating position to initiate the actuation of the device and a particular improved spring return system for moving the drive piston and fastening driving element through the return stroke thereof.

Another object of the present invention is the provision of a pressurized gas actuated portable tool such as provided in the prior art which embodies one or more of the features which are preferably included in the device of the present invention as indicated above.

These and other objects of the present invention will become more apparent during the course of the following detailed description and appended claims.

The invention may best be understood with reference to the accompanying drawings wherein an illustrative embodiment is shown.

IN THE DRAWINGS

Figure 1:
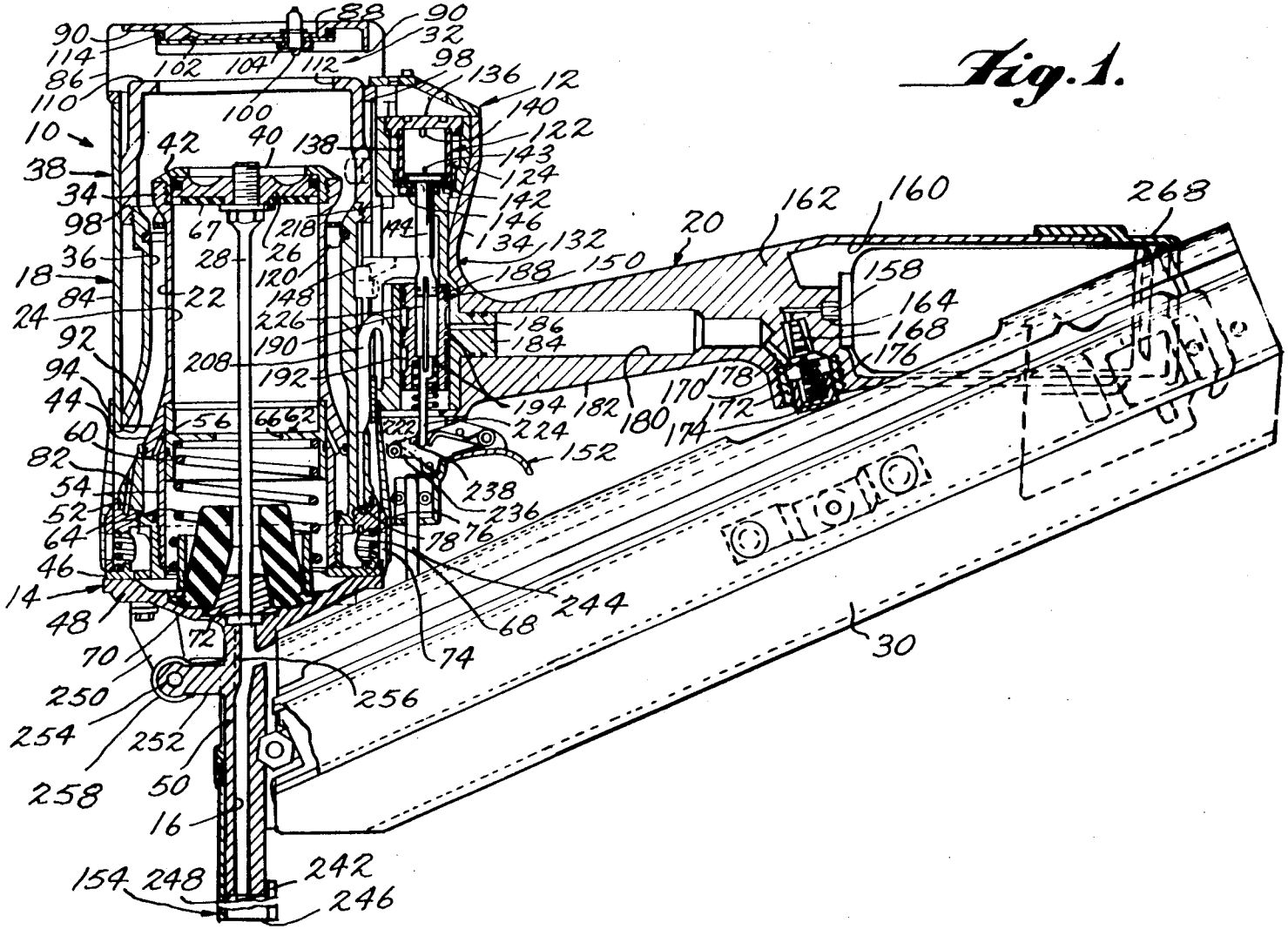
FIG. 1 is a side elevational view of an internal combustion actuated fastener driving device embodying the principles of the present invention with most of the parts being shown in their inoperative positions in vertical section for purposes of clearer illustration.

Referring now more particularly to the drawings, there is shown therein an internal combustion actuated fastener driving device, generally indicated at 10, which embodies the principles of the present invention. The device 10 includes a portable housing assembly, generally indicated at 12, which, in the preferred embodiment shown, includes a workpiece engaging portion or nosepiece, generally indicated at 14, defining a fastener drive track 16, a main body portion, generally indicated at 18, fixed to the upper end of the workpiece engaging portion 14 defining an acceptable housing profile and a handle portion, generally indicated at 20, extending transversely from the main body portion 18 for enabling the user to manually move the housing assembly 12 in portable fashion.

The main body portion 18 includes a fixed inner annular wall 22, the interior surface of which defines a cylindrical drive chamber 24, within the housing assembly 12. A drive piston 26 is slidably sealingly mounted in the cylindrical drive chamber 24 for movement through repetitive cycles each of which includes a drive stroke and a return stroke. A fastener driving element 28 is operatively connected with the drive piston 26 and extends downwardly therefrom into the fastener drive track 16 for movement therein with the drive piston 26 through a drive stroke in response to the drive stroke of the piston and a return stroke in response to the return stroke of the piston.

A magazine assembly 30 of any suitable construction is connected at its forward end with the work engaging housing portion 14 and at its rearward end with the rearward end of the handle portion 20. As shown, the magazine assembly 30 is of a size and configuration to receive a supply of fasteners in the form of a stick of D-head nails with the shanks abutting and to feed the forwardmost nail of the stick into the drive track 16 to be driven therefrom by the fastener driving element 28 during the drive stroke thereof. As indicated, the magazine assembly 30 shown is merely exemplary and it will be understood that any type of magazine assembly may be utilized.

Mounted within the main body housing portion 18 in a position above the cylindrical drive chamber 24 is a combustion chamber, generally indicated at 32. The combustion chamber assembly 32 communicates at one end with the drive chamber 24 and through an annular inlet 34 with an annular mixing chamber 36, the interior periphery of which is defined by the exterior periphery of the fixed interior housing wall 22.

The exterior periphery of the combustion chamber 32 forms an upper part of a main valve assembly, generally indicated at 38, in the form of an annular wall structure which is disposed in surrounding relation to the fixed interior wall 22 of the housing assembly 12. The main valve assembly 38 is mounted for vertical sliding movement with respect to the fixed wall 22 between open and closed positions. As shown, the fixed interior annular wall 22 has an annular piston retainer element 40 fixed to the upper end thereof which forms a stop for drive piston 26 during the return stroke thereof. The drive piston 26 includes annular seal elements 42 which serve to frictionally retain the piston in its stopped position.

Formed on the exterior periphery of the fixed interior wall 22 at a position spaced above the lower end thereof is a thickened flared skirt portion 44. The exterior periphery of the fixed wall 22 below the skirt portion 44 defines a smooth cylindrical surface which slidably receives the lower end of the annular wall structure forming the main valve assembly 38. As shown, the lower extremity of the fixed interior wall 22 is threadedly engaged with an upstanding skirt of a transverse housing member 46, which, in turn, is fixed to an upper transverse wall 48 of the work engaging portion 14, the remainder of which includes a generally tubular section 50 within which the fastener driving track 16 is defined extending downwardly from the center of the transverse wall 48.

The annular wall structure which defines the main valve assembly 38 includes a lower intermediate annular portion 52 having an inwardly directed flange formed with a groove to receive an O-ring seal which also engages the cylindrical surface of the fixed wall 22. The lower intermediate portion 52 of the main valve assembly 38 includes an interior cylindrical surface extending upwardly from the inwardly directed flange which slidably sealingly engages an O-ring seal formed in a suitable groove in the exterior periphery of the skirt portion 44. It will be understood that the O-ring seals and cylindrical surfaces define an annular pressure chamber 54 which communicates with the interior of the fixed interior annular wall 22 by a series of passages 56 extending diagonally upwardly through the skirt portion 44.

The passages 56 communicate with a lower interior cylindrical surface of the fixed interior annular wall 22 which defines with the interior cylindrical surface defining the drive chamber 24 an annular shoulder having a bumper ring 58 abutting the same. Communication of the inner ends of the passages 56 with the drive chamber 24 is controlled by a sleeve 60, forming a part of a spring return assembly, generally indicated at 62, for effecting successive return strokes of the drive piston. Sleeve 60 is mounted in sliding engagement with the cylindrical surface below the bumper ring 58 and sealed by O-ring 59 mounted in an exterior groove of sleeve 60. A coil spring 64, which forms a part of the piston return assembly 62, serves to resiliently bias the sleeve 60 into an uppermost position wherein its upper edge is engaged with the bumper ring 58.

The sleeve 60 includes an inwardly extending central flange 66, the lower surface of which is engaged by the upper end of the return spring 64 and the upper surface of which is adapted to be engaged by a resilient pad 67 fixed to the lower surface of the drive piston 26. The lower end of the return spring 64 engages the lower flange of a spring guide sleeve 68 which, in turn, extends around an annular bumper 70 of resilient material mounted on the central portion of the transverse wall 48 of the work engaging portion 14 in a position to be engaged by the piston to define the end of the drive stroke thereof. As shown, a fitting 72 is mounted within the nosepiece 14 and extends within the resilient bumper 20. The fitting 72 is apertured to receive therein the fastener driving element 28. It will be understood that the fastener driving element 28 can be connected in any suitable fashion to the drive piston 26 and, as shown, the connection is a simple threaded one.

The manner in which the main valve assembly 38 is biased to move between its open and closed positions is a feature of the present invention. The pressure chamber 54 constitutes one means for biasing the main valve assembly 38 into its open position when gas under pressure is communicated with that chamber through the passages 56 normally closed when the sleeve 60 is in its raised position in sealing relation with the bumper ring 58 by virtue of the bias of the return spring 64. The main valve assembly 38 is also resiliently biased into its closed position by a coil spring 74 which seats at its lower end on the fixed transverse housing member 46 and at its upper end with a lower grooved surface of a lower annular portion 76 of the annular wall structure forming the main valve assembly 38. As shown, the lower annular portion is interiorly threaded to engage exterior threads on the flange of the lower intermediate annular portion 52 of the main valve assembly 38. In its fixed position of engagement, the separate lower annular portion 76 includes a depending skirt which surrounds the coil spring 74 and an upstanding skirt which engages an O-ring seal formed in a groove on the exterior of the lower intermediate annular portion 52.

The lower annular portion 76 includes a central annular groove 78 formed in the upper surface thereof which communicates with an inlet passage 80 extending upwardly through the rearward end of the intermediate annular portion 52. Mounted on the lower intermediate annular portion 52 are a series of upwardly and inwardly extending nozzles 82 spaced annularly about the lower end of the drive chamber 24. As shown, each nozzle 82 is in the form of a generally cylindrical element fixedly mounted in a diagonally extending bore and having a through bore the upper end of which defines the exit of the nozzle 82 and the lower end of which is counterbored to communicate with the annular groove 78. The nozzles 82 serve to emit a gaseous fuel under pressure contained within the annular groove 78 in a series of annularly spaced jet stream formations directed into the mixing chamber 36.

The main body portion 18 of the housing assembly 12 includes a fixed exterior annular wall 84 which is fixed at its lower end to the outer end of the transverse housing member 46 and has a cap structure 86 fixed to its upper end as by bolts or the like. The cap structure 86 includes an upper transversely extending wall 88 which defines the top or upper profile of the main body portion of the housing assembly. The cap structure 86 includes an annular skirt portion which extends downwardly from the transversely extending wall 88 which has forwardly and rearwardly disposed openings 90 formed therein which define an outlet for the combustion chamber assembly 32 and serve to communicate the same with the atmosphere.

The lower end portion of the fixed exterior annular wall 84 is formed with a series of annularly spaced openings 92 which form a series of fresh air inlets communicating with the lower end of the mixing chamber 36 at a position adjacent the discharge from the nozzles 82. A filter sleeve 94 is fitted over the lower end of the fixed exterior housing wall 84 and the openings 92 to provide a filter for the flow of atmospheric air into the fresh air inlets.

As shown, the main valve assembly 38 includes a central portion 96 which is suitably fixed to the lower intermediate portion 92 by any suitable means such as by bolts extending into lugs formed exteriorly on the two portions or the like. The interior peripheral surface of the central portion 96 defines the exterior periphery of the mixing chamber 36. As shown, the upper end of the fixed interior housing wall 22 includes an outwardly extending thickened portion having a generally cylindrical exterior defining the interior surface of the annular inlet 34 between the mixing chamber and the combustion chamber 32.

Fixedly mounted on the exterior surface of the housing wall 22 below the thickened portion are a series of annularly spaced vanes 97, each of which is disposed at an angle to the axial extent of the housing wall. As shown, there are four equally spaced vanes extending at 45° angles to the axial extent, although, it will be understood that less than or more than four vanes 97 may be provided and that the angle can be more or less than 45°. The purpose of the vanes 97 is to impart a swirl to the air and gas mixture as it passes from the mixing chamber 36 into the combustion chamber 32.

The main valve assembly 38 includes an upper annular portion 98 having its lower interior periphery threaded to threadedly engage exterior threads formed on the upper periphery of the central portion 96. The upper annular portion 98 of the main valve annular wall structure defines the periphery of the combustion chamber 32.

The transverse wall 88 of the cap structure 86 is eccentrically, apertured to receive therethrough a spark plug 100, the base of which also extends through an eccentric opening of a disk 102. A nut 104 serves to retain the spark plug 100 and disk 102 in assembled relation so that the disk defines the upper end of the combustion chamber 32 the lower end of which communicates with the upper open end of the drive chamber 24. The eccentric position of the single spark plug 100 (or plural plugs, if desired) insures that ignition will begin near the outer portion of the swirling mixture within the combustion chamber 32.

The upper annular portion 98 of the main valve annular wall structure terminates at its upper end in an inwardly extending annular flange 110 defining a cylindrical surface 112. When the main valve assembly 38 is disposed in its closed position, the cylindrical surface 112 engages the exterior of an O-ring seal 114 fixed below the transverse wall 88 of the cap structure 86 by the upper marginal periphery of the disk 102.

Figure 3:
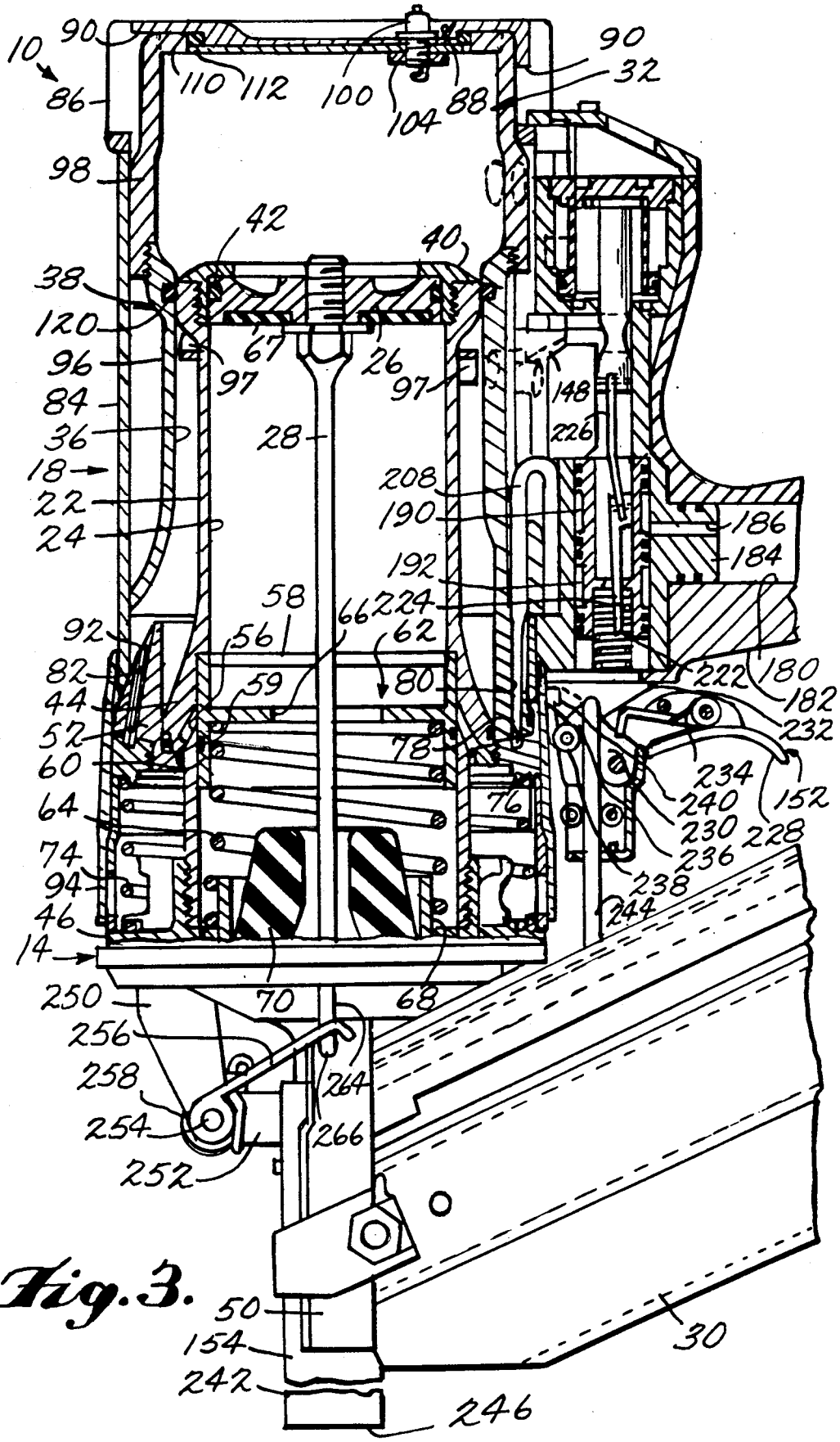
FIG. 3 is a view similar to FIG. 2 showing the position of the parts immediately following ignition.

It will also be noted that when the valve assembly 38 is in its closed position as shown in FIG. 3, an O-ring 120 mounted within an appropriate annular groove on the interior periphery of the central portion 98 of the annular valve structure engages the peripheral cylindrical surface on the enlargement of the upper end of the fixed interior housing wall 22 defining the annular inlet 34. When the main valve assembly 38 is moved into its open position the O-ring seal 120 is displaced below the cylindrical surface of the annular inlet 34 so that the upper section of the central portion 98 of the annular valve structure which flares outwardly from the O-ring seal 120 defines the exterior periphery of an annular inlet 34 between the annular mixing chamber 36 and the combustion chamber 32. It will also be noted that the diameter of the surface defining the inner periphery of the annular inlet 34 is slightly more than the interior diameter of the cylindrical surface 112 so that when the main valve assembly 38 is in its closed position, there is a differential pressure area provided by the flange which defines the interior cylindrical surface 112 which is acted upon by the pressure conditions within the combustion chamber 32 so as to bias the main valve assembly 38 to be maintained in its closed position once it has been moved therein. In this regard, the axial extent of the cylindrical surface defining the inner periphery of the annular inlet 34 is slightly greater than the axial extent of the cylindrical surface 112 so that the inlet 34 closes slightly before the outlet 90 when the main valve assembly 38 is moved into its closed position and, conversely, the outlet 90 opens slightly before the inlet 34 when the main valve assembly 38 is moved out of its closed position.

The main valve assembly 38 is biased to be retained in its open position by a timing assembly, generally indicated at 122, which serves to time the movement of the main valve assembly 38 from its open position into its closed position in conjunction with the communication of a measured charge of fuel under pressure from a gaseous fuel charge or measuring chamber 124 with the nozzles 82 during which the jet stream formations of the pressurized gaseous fuel passing from the nozzles 82 aspirates air through the fresh air inlets 92 to mix therewith and flow through the annular mixing chamber 36 and annular inlet 34 into the combustion chamber 32.

Preferably, the timing assembly 122 operates to delay the beginning of the movement of the main valve assembly 38 so that the movement itself can take place rather rapidly rather than to attempt to extend the time required to complete the movement from the beginning to the end. Preferably, the timing is accomplished in response to the diminishing of the gaseous fuel pressure within the gaseous fuel chamber 124 communicated with the nozzles 82. That is, when the predetermined measured charge of gaseous fuel under pressure is first communicated with the nozzles 82, it will be at a initial pressure and as the predetermined charge of gaseous fuel issues through the nozzles 82, the charge pressure will diminish. The timing assembly 122 is operable to initiate the movement of the main valve from its open position in response to the gaseous fuel pressure communicating with the nozzles reaching a predetermined diminished pressure below the initial pressure.

As best shown in FIGS. 2–4 and 10–12, the timing assembly 122 is preferably in the form of a piston and cylinder unit embodied within the gaseous fuel chamber 124 and connected to move with the main valve assembly 38. The gaseous fuel chamber 124 is provided in an upper portion of a fitment, generally indicated at 132, engaged within a hollow forward section 134 of the handle portion 20 of the housing assembly 12 which is fixedly connected with the exterior housing wall 84, as by suitable fasteners or the like. The gaseous fuel chamber 124, as shown, is open at its upper end to receive a closure 136 and to permit a cylindrical wall 138 to be engaged within the gaseous fuel chamber 124 which defines the cylinder of the timing assembly 122. The cylindrical wall 138 includes a series of slots 140 formed in its upper edge which communicate the interior of the cylinder 138 at all times with the remainder of the gaseous fuel chamber 124 which surrounds the exterior of the cylindrical wall 138.

The timing assembly 122 also includes a timing piston 142 which is disposed within the lower end of the timing cylinder 138 when the main valve assembly 38 is in its open position. As shown, there are a series of openings 143 extending through the cylindrical wall 138 at a position spaced just above the piston 142 when in its lowermost position. A piston rod 144 is connected with the timing piston 142 and extends downwardly through an intermediate transverse wall 146 formed in the fitment 132 and into a central portion of the fitment which is open in a direction toward the main valve assembly 38. It will be noted that the fixed exterior housing wall 84 is also formed with an adjacent opening which enables the piston rod 144 to communicate directly with the rearward exterior of the central portion 96 of the annular valve structure. A bracket 148 is fixed at one end to the exterior surface of the central portion 96 of the annular valve structure and at its opposite end with the piston rod 144 as by a tongue and groove connection.

The communication of the gaseous fuel under pressure within the gaseous fuel chamber 124 with the nozzles 82 is under the control of an actuating valve 150, which, in turn, is controlled in response to a predetermined manual actuating procedure performed with respect to a trigger assembly, generally indicated at 152, and a control trip assembly, generally indicated at 154. The actuating valve 150 also serves to control the replenishment of the gaseous fuel chamber 124 with a new charge of gaseous fuel under pressure after the charge therein has been expended.

A feature of the present invention is that a replenishable supply of gaseous fuel under pressure can be contained within a simple container 156, an exemplary embodiment of which is shown in FIG. 1. The container 156 includes a simple outlet valve 158 which communicates with an interior chamber for receiving liquid fuel under pressure. An exemplary fuel is methylacetylene propadiene. As shown, there is a container receiving cavity 160 formed in a rearward section of the handle portion 20. The handle portion 20 includes an intermediate wall 162 defining the inner end of the container receiving cavity 160 which is formed with a valve receiving element 164. When the container 156 is moved into the cavity 160, the outlet valve 158 thereof enters the receiving element 164 and actuates the valve 158 to communicate the interior of the container with the inner end of a bore 166 formed in the intermediate wall. The bore 166 includes a first counterbore within which is mounted a conventional tire valve 168 so that the actuating end of the stem extends in a direction away from the inner end of the bore 166. The bore 166 includes a second counterbore which defines a shoulder for receiving the peripheral marginal edge of a diaphragm 170 which is retained in the second counterbore by a sleeve 172 which is threaded therein. The sleeve has a threaded opening in the central portion thereof for threadedly receiving an adjusting cap 174 which engages one end of a coil spring 176, the opposite end of which engages the center of the outer surface of the diaphragm 170. The opposite inner surface of the diaphragm 170 engages the stem of the tire valve 168.

When the stem of the tire valve 168 is moved inwardly, pressure from the supply container can pass through the tire valve 168 to act on the associated inner surface of the diaphragm 170. The action of the diaphragm 170 with the tire valve 168 converts the tire valve into a pressure regulating valve assembly for the chamber defined by the inner surface of the diaphragm between the first and second counterbores. This chamber is communicated by a suitable passage 178 with the rearward end of a supply chamber 180 formed within a forward hand grip section 182 of the handle portion 20. Supply chamber has a volume greater than the charge chamber 124.

The fitment 132 includes a projecting cylindrical portion 184 formed with suitable exterior grooves to receive seals which engage the interior periphery of the supply chamber 180 at the forward end thereof. The cylindrical plug portion 184 has a bore 186 formed therethrough which serves to communicate the gaseous fuel supply chamber 180 with an actuating valve cavity 188 formed in the lower portion of the fitment 132 with its axis extending perpendicular to the axis of the bore 186.

The actuating valve 150 is preferably in the form of a hollow valve member slidably sealingly mounted within the actuating valve cavity 188 for movement between an inoperative position and an operative position therein. The actuating valve member 150 has formed in its exterior periphery a pair of axially spaced upper and lower annular grooves 190 and 192 so as to define annular land portions on the ends and central portion of the actuating valve member which are suitably grooved to receive O-ring seals 194. As shown, the bore 186 leading from the gaseous fuel pressure supply chamber 180 communicates with the upper annular groove 190 when the actuating valve member 150 is both in its inoperative position and in its operative position. As best shown in FIG. 11, the fitment 132 has a passage 196 formed therein in communication with the valve cavity 188 at a position to communicate with the upper annular groove 190 when the actuating valve member 150 is in its inoperative position and the lower annular groove 192 when the actuating valve member 150 is moved into its upper operative position. The passage 196 communicates with a vertical passage 198 formed in the fitment 132 which communicates with the charge chamber 124 exteriorly of the cylindrical wall 138.

As best shown in FIG. 12, the fitment 132 is also formed with the passage 200 extending therethrough into communication with the valve cavity 188 at a position to be communicated with the lower annular groove 192 thereof both when the actuating valve member 150 is in its lower inoperative position as well as its upper operative position. A vertical passage or bore 202 communicates with the central portion of the passage 200 and with a slanted passage 204 which communicates with the charge chamber 124 within the cylindrical wall 138 through the lower transverse wall 146. The outer end of the passage 200 has an angular nipple 206 fixed therein which, in turn, has one end of a flexible tube 208 connected therewith. The flexible tube 208 loops upwardly and then downwardly and has its opposite end fixed as by a nipple or the like with the passage 80 in the lower intermediate portion 52 of the annular valve structure.

When the actuating valve 150 is in its normal inoperative position, the underside of the timing piston 142 is communicated with the atmosphere through the slanted passage 204, bore 202, tube 208, groove 78 and nozzles 82. Moreover, it will be noted that passage 204 is isolated from communication with the passage 198 when the actuating valve 150 is in its normal inoperative position. On the other hand, the passage 196 is communicated with the supply passage 186 by the upper annular groove 190 in the actuating valve member 150 so that when the latter is in its normal inoperative position, the supply chamber 180 is communicated with the charge chamber 124. When the actuating valve 150 is moved into its operative position, the supply passage 186 is isolated and the passages 200 and 196 are communicated by the lower annular groove 192 of the actuating valve member 150, thereby communicating the charge chamber 124 with the nozzles 82 as well as communicating the underside of the timing piston 142 with the pressure within the charge chamber which is communicated with the nozzles.

In this way, the charge of gaseous fuel under pressure within the charge chamber 124 is communicated with the nozzles 82 by the movement of the actuating valve into its operating position. As the jet formation of gaseous fuel issues from the nozzles, fresh air is induced to flow through the fresh air inlets 92, which is entrained in the gaseous fuel and mixed therewith for passage through the mixing chamber 36 and into the combustion chamber 32 moving the spent gases in the combustion chamber 32 outwardly through the outlet. As the pressure of the charge of gaseous fuel is diminished by dissipation through the nozzles 82 and reaches a predetermined value, the spring bias of the spring 74 overcomes the gas bias acting on the timing piston 142 and commences the closing of main valve assembly 38, which closing is completed preferably in timed relation to the movement of the last spent gases from the outlet 90. The new charge of combustible gases within the combustion chamber 32 is ignited by the spark plug 100. Electrical current is transmitted to the spark plug 100 to provide a spark ignition of the combustible gases by a piezoelectric mechanism 218 of conventional configuration.

Figure 6:
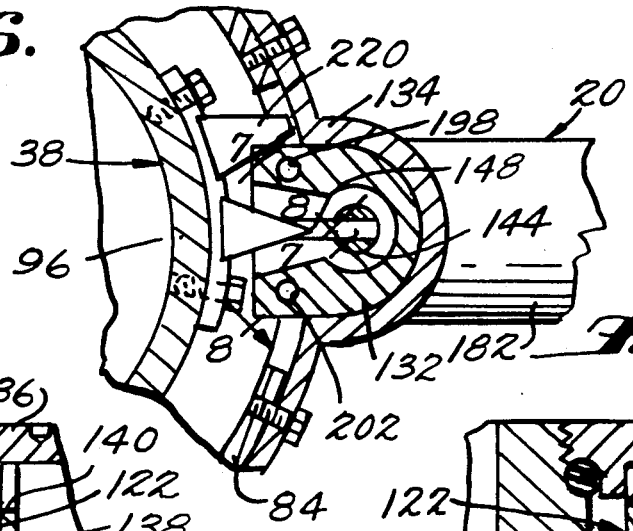
FIG. 6 is an enlarged fragmentary sectional view taken along the line 6—6 of FIG. 2.

As best shown in FIG. 6, the bracket 148 includes a second arm 220 extending at an angle from the arm which connects with the piston rod 144. The second arm 220 moves within suitable openings formed in the fitment 132 so as to strike the piezoelectric mechanism 218 when the main valve assembly 38 reaches the end of its movement into its closed position. The nature of the piezoelectric mechanism 218 and its operation is conventional and any suitable unit may be utilized which is capable of generating sufficient electrical current for transmittal to the spark plug 100.

It is a feature of the present invention that the actuating valve 150 is moved from its normal inoperative position into its operative position in response to the performance of a predetermined manual actuating procedure, but that the actual movement is effected by a spring rather than the manual actuating procedure itself so that the rate of movement of the actuating valve cannot be varied manually. As shown, the actuating valve member 150 includes an inner flange against which one end of a coil spring 222 is mounted, the opposite end of which engages the section of the handle portion 20 below the valve cavity 188 which is slotted to receive therethrough an actuating Valve moving member 224. The actuating valve moving member 224 is connected for movement with the main valve assembly 38 by a leaf spring 226 which is connected at a lower end with the actuating valve moving member 224 and at an upper end with the lower end of the timing piston rod 144. The leaf spring 226 serves to resiliently bias the valve moving member laterally into a valve retaining position. As shown, the actuating valve moving member 224 includes a downwardly facing shoulder which engages the upper surface of the interior flange of the actuating valve 150 when the valve moving member 224 is in a valve-retaining position so as to prevent movement of the actuating valve 150 under the bias of the spring 222 out of the normal inoperative position thereof.

The flexure of the leaf spring 226 enables the valve moving member 224 to be moved laterally from its valve retaining position into a valve releasing position wherein the shoulder is moved out of engagement with the flange permitting the actuating valve member 150 to be moved from its normal inoperative position into its operative position by the bias of the coil spring 222.

The valve moving member 224 is moved from its releasing position into an actuating valve engaging position during and with the movement of the main valve assembly 38 from the open position thereof into the closed position thereof. In the actuating valve engaging position, which is illustrated in FIG. 3, the shoulder again is in a position above the flange so that when the valve moving member 224 is moved during and with the movement of the main valve assembly 38 from the closed position thereof into the open position thereof, the valve moving member 224 will carry with it the actuating valve member 150 so as to move it from its operative position into its inoperative position and retain it therein against the bias of spring 222.

The valve moving member 224 is moved laterally from its valve retaining position into its valve releasing position by a predetermined manual movement of the trigger assembly 152 and the contact trip assembly 154. Preferably, the predetermined movement is a sequential movement first of the contact trip assembly 154 and then of the trigger assembly 152 although it is within the contemplation of the invention to effect the movement by a concomitant movement of both without regard to the sequence of movement.

The trigger assembly 152 includes a trigger member 228 which is of generally inverted U-shaped cross-sectional configuration including a curved bight portion for digital engagement and parallel leg portions. The forward lower end of the leg portions are pivotally mounted on a pin 230 which extends between a pair of parallel plate sections formed on the handle portion 20 at positions below and on opposite sides of the valve cavity 188. The pin 230 serves to pivotally mount the trigger member 228 on the housing assembly 12 for movement between a normal inoperative position and an operative position. Extending between the rearward end of the leg portions is a pivot pin which serves to pivot one end of an L-shaped lever 232 to the trigger member 228, the opposite end of which forms an abutment for engaging the lower end of the valve moving member 224. A hair pin spring 234 serves to resiliently urge the lever 232 upwardly into an operative position in engagement with a stop pin so as to permit downward movement of the lever 232 away from the pin into an inoperative position.

In the preferred sequential operating arrangement shown, the trigger member 228 is retained against movement out of its inoperative position by a spring biased interlock member 236 in the form of a pivoted lever. The interlock member 236 is pivoted to the housing assembly between the depending plate sections by a pivot pin which serves to mount the interlock member for pivotal movement between inoperative and operative positions. The interlock member 236 includes a trigger abutment portion 238 which is adapted &o engage a corresponding notch in the upper corner of the legs of the trigger member 228 when the latter is in its inoperative position. A hair pin spring 240 serves to resiliently bias the interlock member 238 into its inoperative position. It will also be noted that the trigger abutment portion extends in a position across the lower end of the valve moving member 224 so as to positively prevent lateral movement of the valve moving member 224 from its valve retaining position into its valve releasing position when the interlock member 236 is in its inoperative position.

The contact trip assembly 154 includes a contact trip member 242 which, as shown, is preferably made of sheet metal bent so as to embrace the lower end of the tubular portion 50 of the nosepiece 14 and to extend over the front end thereof. The contact trip assembly 154 also includes a bent rod 244, a lower end of which is connected with the contact trip member 242 as shown in dotted lines in FIG. 5 and an upper end of which extends through a roller fitment secured between the lower end of the plate sections below the trigger assembly 152.

The contact trip member 242 is mounted with respect to the nosepiece 14 for rectilinear movement between a normal inoperative position and an operative position. In the inoperative position of the contact trip member 242, a lower work-engaging surface 246 thereof extends below a lower work-engaging surface 248 of the tubular portion 50 of the nosepiece 14. The contact trip member is moved from its inoperative position into its operative position by first engaging the surface 246 with the workpiece and then moving the housing assembly 12 downwardly until the surface 248 also engages the workpiece.

Since the bent rod 224 is fixed with respect to the contact trip member 242, the upper end thereof is moved rectilinearly with the movement of the contact trip member 242 from its inoperative position as shown in FIG. 1 upwardly into engagement with an abutment surface of the interlock member 236 so as to pivot the interlock member 236 in a counterclockwise direction against its spring bias into its operative position. This releases the trigger member 228 for digital movement from its inoperative position into its operative position.

Figure 5:
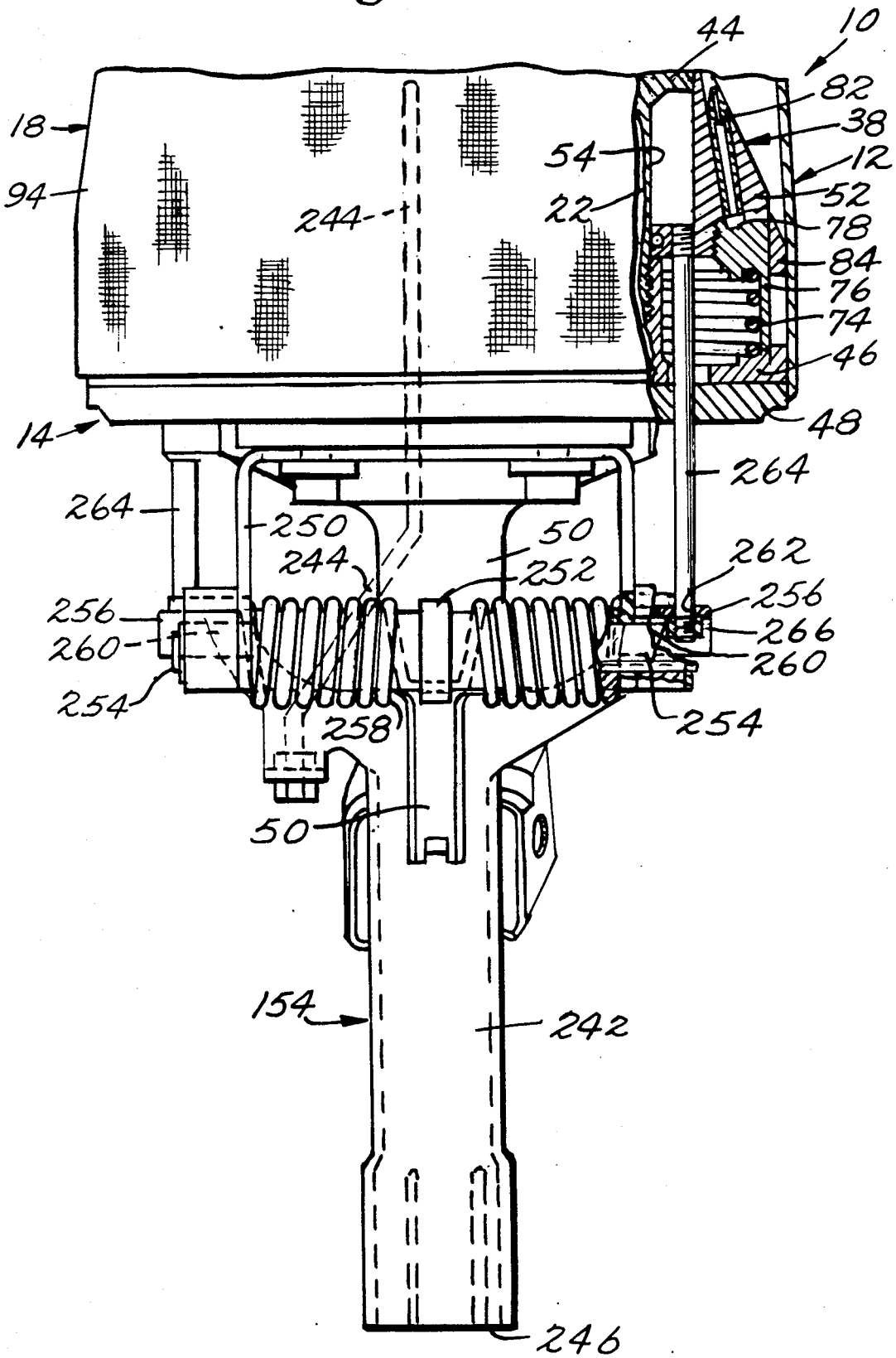
FIG. 5 is a fragmentary front elevational view of the lower portion of the device shown in FIG. 1, with some parts above the nosepiece being broken away for purposes of clearer illustration.

Referring now more particularly to FIG. 5, there is shown therein a further spring biasing means for biasing the main valve assembly 38 into its open position under the control of the contact trip assembly 154. As shown, an inverted U-shaped bracket 250 is fixed by its bight portion below the forward portion of the transverse wall of the nosepiece so that its legs extend downwardly. Extending forwardly from the tubular portion 50 of the nosepiece 14 in a position between the lower ends of the legs of the U-shaped bracket 250 is an integral lug 252. Extending through aligned openings in the lower ends of the legs of the U-shaped bracket 250 and the lug 252 is a shaft 254 having opposite ends extending outwardly from the legs of the bracket 250. Pivotally mounted on each end of the shaft is a lever 256 including a hub portion pivoted to the shaft 254 and an outwardly extending arm portion curved at its outer extremity. A double coil spring 258 is mounted over a pair of suitable spacer sleeves mounted on the shaft 254 between the leg ends of the bracket 250 and the central lug 252. A central U-shaped portion of the double coil spring 258 engages the undersurface of the lug 252 and each one of the double coils includes a free end which extends axially through an appropriate lug on the arm portion of the associated lever 256. The double coil spring 258 thus serves to resiliently bias each of the levers 256 into a normal inoperative position wherein the underside of each arm portion engages the upper surface of an upwardly and outwardly extending arm portion 260 formed on the contact trip member 242. The arrangement is such that when the contact trip member 242 is moved from its inoperative position into its operative position, the arm portions 260 thereof serve to pivot the levers 256 from their inoperative positions against the bias of the double coil spring 258 into operative positions.

Figure 2:
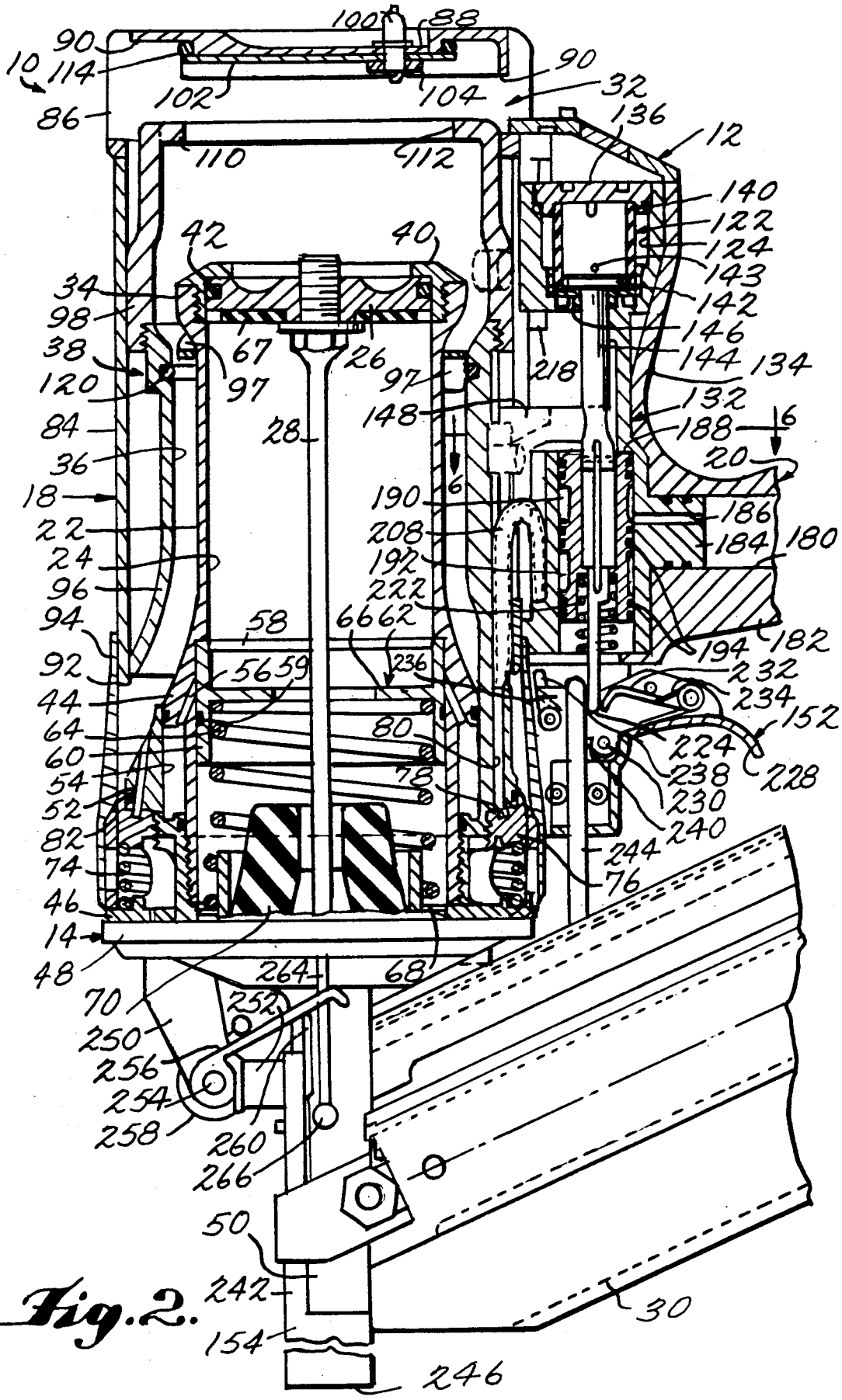
FIG. 2 is a fragmentary side elevational view with the parts above the nosepiece in vertical section, the parts being shown in the position they assume immediately following the movement of the trigger member into its operative position after the contact trip member has been moved into its operative position.

The arm portion of each lever 256 includes an elongated slot 262 therein disposed laterally of the associated contact trip member arm portion 260. Each slot 262 receives the lower end of a connecting rod 264 having a cylindrical nut element 266 threaded to a lower end portion thereof below the arm portion of the associated lever 256. Each connecting rod 264 extends upwardly through an appropriate opening in the transversely extending wall 48 of the nosepiece portion 20 and is threadedly engaged within threaded bores formed in the lower intermediate portion 52 of the annular valve structure. The arrangement is such that when the contact trip member 242 is in its inoperative position the bias of the double coil spring 258 acting on the arm portions of the levers 256 constitutes an additional downward bias on the main valve assembly 32 which tends to maintain it in its open position. When the contact trip member is moved from the inoperative position thereof into the operative position thereof, levers 256 move into their operative positions, as shown in FIG. 2, thus relieving the main valve assembly 38 from the bias of the double coil spring 258. As shown in FIG. 2, when the main valve assembly 38 moves into its closed position, the cylindrical nut member 266 is again disposed in a position just below the associated arms so that when the contact trip member 242 is allowed to return to its inoperative position, the bias of the double coil spring 258 will be added to the main valve assembly to thus return the same into its open position.

OPERATION

FIG. 1 illustrates the position of the parts of the device 10 in their inoperative positions preparatory to the operation of the device. It will be noted that a fuel canister or container 156 has been engaged within the cavity 160 so that the valve 158 thereof is opened by the fitting 164. A detachable cap 268 serves to retain the container 156 in the cavity 160 with the valve 158 in its open condition. The fuel under pressure, which initially may be in a liquid state within the container 156, is communicated continuously with the bore 166. The tire valve 168 within the inner end of the bore 166 is in its open position by virtue of the spring bias of the spring 176. The gaseous fuel under pressure therefore enters through the passage 178 into the gaseous fuel supply chamber 180. From the gaseous fuel supply chamber 180, the gaseous fuel passes into the passageway 186.

Figure 7:
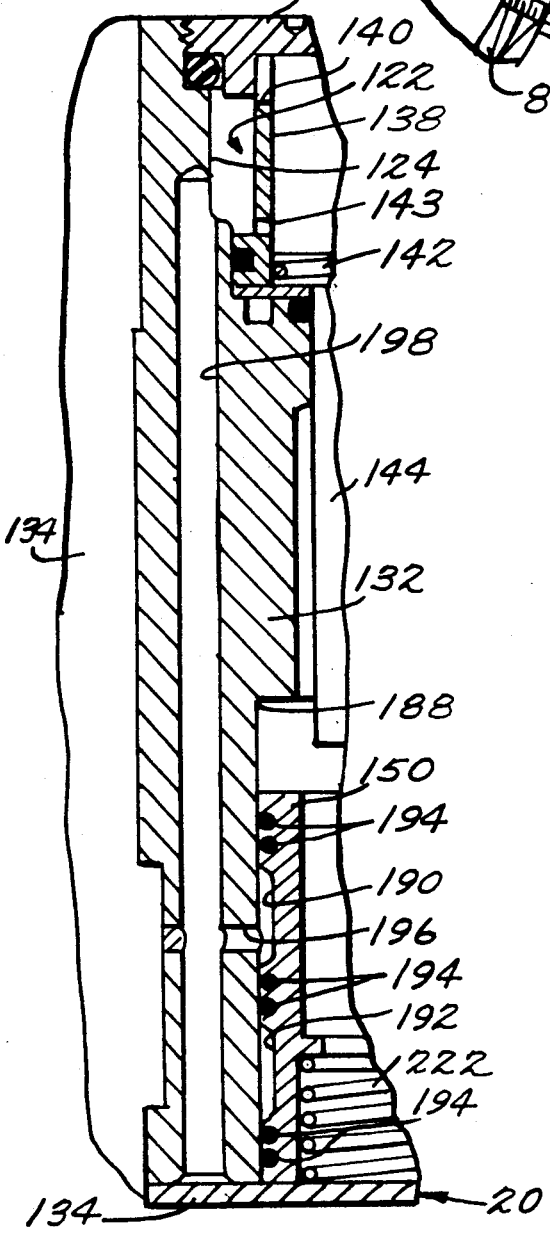
FIG. 7 is a fragmentary sectional view taken along the line 7—7 of FIG. 6.
Figure 8:
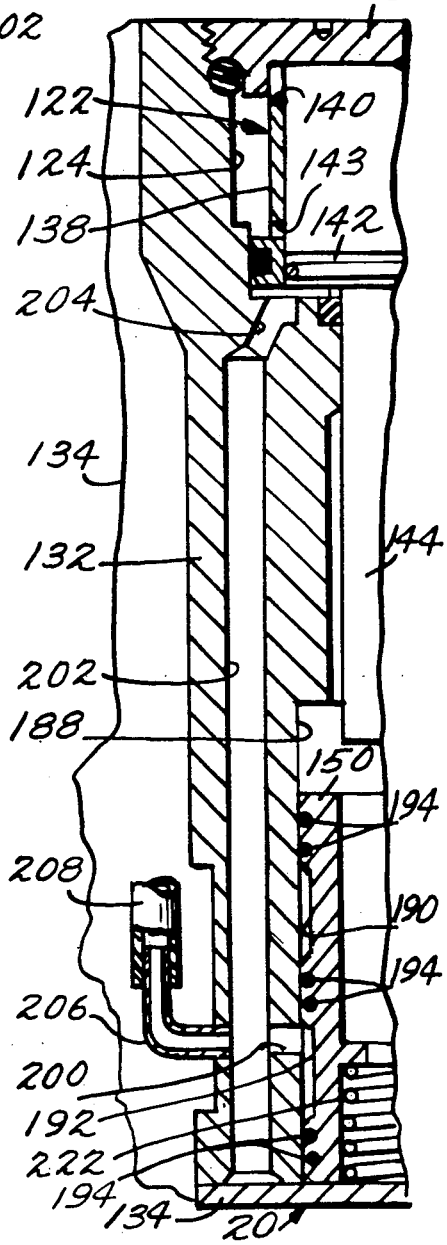
FIG. 8 is a fragmentary sectional view taken along the line 8—8 of FIG. 6.

Actuating valve 150 is retained in its inoperative position against the bias of spring 222 by the valve moving member 224 which is biased into its valve retaining position by the leaf spring 226 and held therein by virtue of the main valve assembly 38 being in its open position and the timing piston 142 and timing piston rod 144 connected to the main valve assembly by the bracket 148 being in its retracted position. As best shown in FIG. 7, the upper annular groove 190 of the actuating valve 150 serves to communicate the supply passage 186 with the passage 196 which, in turn, communicates the gaseous fuel with the charge chamber 124 through passage 198 so as to fill the same with a charge of gaseous fuel under pressure. In this regard, it will be noted by viewing FIG. 8 that the bottom surface of the timing piston 142 is communicated with the nozzles 82 and, hence, to the atmosphere through passages 204 and 202, nipple 206, flexible tube 208, passage 80, and annular groove 78. It will also be noted that the passage 200 is isolated from the passage 196 by virtue of the actuating valve being disposed in its inoperative position.

In the inoperative position of the device therefore the gaseous fuel pressure within the cylinder 138 acting on the upper surface of the timing piston 142 serves &:o bias the main valve assembly into its open position. This bias, when the gaseous fuel pressure is at its initial predetermined level, is greater than the bias provided by the main valve coil spring 74 acting in a direction to move the main valve assembly 38 into its closed position. In addition, it will be noted that the double coil spring 258 under the control of the contact trip member 242 also serves to bias the main valve assembly 38 into its open position when the contact trip member 242 is in its inoperative position.

The predetermined initial pressure within the gaseous fuel charge chamber 124 is determined by the setting of the pressure regulating valve constituted by the tire valve 168 and diaphragm 170. When the pressure within the chambers 124 and 180 reaches the predetermined initial value, this pressure acts on the diaphragm 170 to move in a direction against the pressure of spring 176 to close the tire valve 168.

The operation of the device 10 is initiated by the operator performing a predetermined actuating procedure, the first step of which includes a portable movement of the entire device 10 by the operator gripping the hand grip section 182 of the handle portion 20. The operator moves the device toward the workpiece to be fastened in a direction to engage the contact trip surface 246 therewith. Further movement of the housing assembly 12 in a direction toward the workpiece will move the entire housing assembly 12 toward the workpiece until surface 248 engages the same. During this movement, the contact trip member 242 is moved from its inoperative position, as shown in FIG. 1, into its operative position, as shown in FIG. 2. In this position, the bias of spring 258 is taken up entirely by the contact trip member 242 and is no longer transmitted to the main valve assembly 38. The movement of the contact trip member 242 from its inoperative position into its operative position also has the effect of moving the interlock member 236 from its inoperative position into the operative position thereof wherein the abutment 238 is disposed in the position shown in FIG. 2 out of the path of lateral movement of the actuating valve moving member 224 and permitting the trigger member 228 to be moved from its inoperative position into its operative position.

The last step in the manual actuating procedure is for the operator to digitally move the trigger member 228 from its inoperative position into its operative position. During this movement, the end of the lever 232 which is in abutment with the lower end of the valve moving member 224 is moved with the trigger member so as to move the valve moving member 224 laterally from its valve retaining position into its valve releasing position wherein the shoulder no longer engages the interior flange of the valve 150. When the valve moving member 224 is moved into its valve releasing position, spring 222 serves to move the actuating valve 150 from its inoperative position into the operative position thereof, as shown in FIG. 2.

The effect of moving the actuating valve 150 into its operative position is to isolate the supply passage 186 and to communicate the previously isolated passage 200 with the passage 196 by means of the lower annular groove 192 of the actuating valve 150. Communicating the passage 200 with the passage 196 serves to communicate both the gaseous fuel chamber 124 and the cylinder 138 with the nozzles 82. It will be noted that, despite the addition of pressure to the underside of the piston 142 which previously was not there, the differential piston rod area still results in the pressure of the gaseous fuel biasing the timing piston 142 downwardly and hence the main valve assembly 38 to remain in its open position.

Communication of the charge of gaseous fuel under pressure within the charge chamber 124 with the nozzles 82 causes the gaseous fuel under pressure to discharge through &.he nozzles as jet stream formations of gaseous fuel. These jet stream formations, which are directed into the mixing chamber 36, serve to aspirate fresh air through the filter 94 and the fresh air inlets 92. The aspirated fresh air mixes with the gaseous fuel in the jet stream formations and passes therewith through the mixing chamber 36 impinges on the vanes 97 which impart a swirling action to the moving mixture. The now swirling mixture passes through the open inlet 34 into the combustion chamber 32. The swirling movement of the mixture of fresh air and gaseous fuel flowing through the mixing chamber 36 displaces the gas therein outwardly through the annular inlet 34 and into the combustion chamber 32. The incoming gases crowd out the gas previously within the combustion chamber 32 outwardly through the outlets 90.

It will be understood that, under normal conditions, the gases within the mixing chamber will constitute a mixture of gaseous fuel and air from the previous operation. In the event that the gas in the mixing chamber is not a combustible mixture, it may take two actuations before the combustion chamber 32 is filled with sufficient combustible mixture to ignite and drive the piston through a drive stroke.

In any event, it will be noted that, as the gaseous fuel under pressure communicating with the nozzles 82 passes through the nozzles, the pressure upstream from the nozzles, as, for example, in the annular groove 78 and gaseous fuel charge chamber 124 is diminished. When this pressure reaches a predetermined diminished value, the bias on the timing piston 124 by the gaseous fuel pressure diminishes to the point that the bias of the coil spring 74 becomes greater and therefore the main valve spring 74 serves to commence the movement of the main valve assembly 38 from its open position toward its closed position.

The value of the predetermined diminished pressure is chosen so that the main valve assembly 38 will be moved into its closed position as the last spent gases within the combustion chamber 32 are crowded out of the combustion chamber 32 through the outlets 90 by the incoming combustible mixture. At a position near the end of the timing stroke of the piston rod 144 and bracket 148 with the main valve assembly, the arm 220 of the bracket 248 engages the piezoelectric unit 218. The effect of the engagement of the piezoelectric unit 218 is to transmit an electrical current through the spark plug 100 so as to cause a spark. Preferably, the position of engagement of the piezoelectric unit 218 is at a time slightly past the initial engagement of the surface 112 of the main valve assembly 38 with the O-ring seal 114. It will be noted that, after this initial movement, there is still a slight amount of movement of the main valve assembly 38 that can take place before it reaches its fully closed position wherein the flange 110 engages wall 88.

When the spark occurs, there is still sufficient swirling movement of the air-fuel mixture within the combustion chamber to effect a desired combustion which creates elevated pressure conditions within the combustion chamber 32. If desired, additional means may be provided to add more movement to the mixture.

The elevated pressure conditions within the combustion chamber 32 has the effect of biasing the main valve assembly 38 to remain in its fully closed position. In this regard, the flange 110 at the end of the main valve assembly 38 provides a net surface area compared with the engagement of the O-ring seal 120 with the inlet surface 34 to provide for this net surface area.

Figure 4:
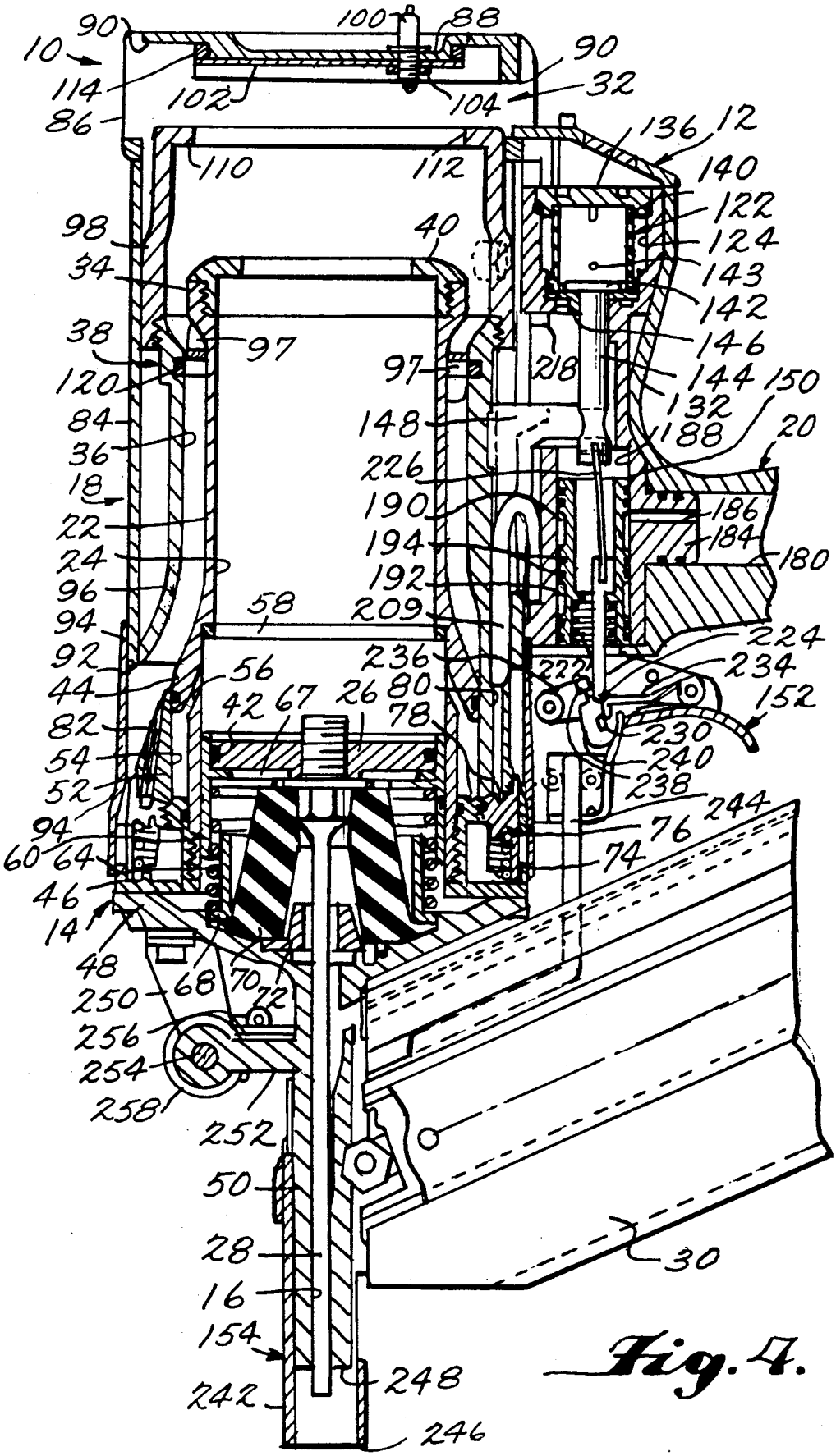
FIG. 4 is a view similar to FIG. 3 with the nosepiece in vertical section showing the position of the parts at the end of the drive stroke of the fastener driving element.

During the movement of the piston 26 through its drive stroke, the lower end of the fastener driving element 28 will engage the upper end of the fastener within the drive track 16 and drive the same outwardly thereof into the workpiece. As the piston 26 reaches the point in its drive stroke where the pad 67 engages the flange 66, the final portion of the drive stroke of the piston 26 will carry with it the sleeve 60 thus progressively stressing the piston return spring 64 until the flange 66 engages the resilient bumper 70 to define the end of the drive stroke, as shown in FIG. 4.

Prior to the drive piston 26 reaching the end of the drive stroke, the sleeve 60 moves past the openings of the passages 56 allowing the gaseous pressure conditions acting on the piston and retaining the main valve assembly 38 in its closed position to be communicated through the passages 56 with the chamber 54. The pressure within the chamber 54 acts on the pressure surface area of the main valve assembly 38 defining the lower surface of the chamber 54, thus overcoming the bias on the main valve assembly 38 tending to retain it in its closed position including the gas pressure acting on the upper flange and the force of the main valve spring 74. In this way, the pressure entering the chamber 54 serves to move the main valve assembly 38 out of its closed position to dump the pressure within the combustion chamber 32 and drive chamber 24 so that the gas bias of the main valve assembly is quickly removed. However, at this point in the operation due to the recoil of the entire housing assembly 12 and the manual action of the operator in allowing the housing assembly 12 to move away from the workpiece, the contact trip element 42 is moved under the action of spring 258 from its operative position back into its inoperative position. The force of the spring 258 is sufficient to overcome the force of the main valve spring 74 and therefore the main valve assembly 38 is moved thereby from its closed position into its open position.

During this movement, the timing piston 142 and piston rod 144 are moved through a return stroke with the main valve assembly 38 which, in turn, causes the valve moving member 224 which has been moved from its valve releasing position shown in FIG. 2 into an upper valve engaging position as shown in FIG. 3 during the movement of the main valve assembly 38 from its open position to its closed position. In its valve-engaging position, the downwardly facing shoulder of the valve moving member 224 is positioned over the inner flange of the actuating valve 150 so that during the return stroke of the piston rod 144 the valve moving member 224 is likewise moved by the leaf spring 226 from its valve-engaging position into its valve-retaining position, thus moving the actuating valve 150 from its upper operative position into its lower inoperative position stressing the valve spring 222, as shown in FIG. 4. It will be noted that, during this movement, if the operator has retained the trigger assembly 152 in its operative position, the lower end of the valve-moving member 224 will engage the lever 232 and pivot it in a counterclockwise direction against the action of spring 234. This position is shown in FIG. 4 and it will also be noted from FIG. 4 that the return of the contact trip member 242 into its inoperative position has the effect of moving the rod 244 downwardly enabling the interlock member 236 to pivot in a clockwise direction under the action of spring 240 into a position blocking the movement of the valve moving member 224 from its valve retaining position into its valve releasing position. With the trigger member 228 in its operative position as shown in FIG. 4, it becomes necessary for the operator to release the trigger 228 enabling the lever 232 to pivot up in a clockwise direction under the action of the spring 234 into a position wherein the outer abutment end thereof is disposed in a position to move the valve moving member 224 laterally from its valve retaining position into its valve releasing position in response to the performance of the next manual actuating procedure.

While it is preferable to utilize all of the features of the present invention in the device 10 according to the present invention, it will be understood that any one or combination of more than one of the features may be embodied in other known devices to improve the performance thereof in accordance with the principles of the present invention.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. An internal combustion actuated portable tool comprising a housing assembly including a workpiece engaging portion having means defining a fastener drive track therein, a main body portion above said workpiece engaging portion defining an acceptable housing profile and having means defining a cylindrical drive chamber therein and a handle portion extending transversely from said main body portion for enabling a user to manually move the housing assembly in portable fashion, a drive piston slidably sealingly mounted in said cylindrical drive chamber for movement through repetitive cycles each of which includes a drive stroke and a return stroke, a fastener driving element operatively connected with said piston and mounted in said fastener drive track for movement therein through a drive stroke in response to the drive stroke of said piston and a return stroke in response to the return stroke of said piston, magazine means carried by said housing assembly for containing a supply of fasteners and feeding successive leading fasteners of the supply into said fastener drive track to be driven therefrom by said fastener driving element during the drive stroke thereof, combustion chamber means above said drive chamber within the acceptable profile defining portion of said housing assembly communicating with an upper open end of said drive chamber, an annular mixing chamber within said housing assembly in surrounding relation with said cylindrical drive chamber below said combustion chamber means, fresh air inlet means communicating with a lower portion of said mixing chamber within said housing assembly, main valve means movable between (1) an open position wherein said combustion chamber means is open at a position of communication with an upper portion of said annular mixing chamber and at a spaced position of communication with the atmosphere and (2) a closed position wherein said combustion chamber means is closed from communication with said mixing chamber and the atmosphere, gaseous fuel chamber means within said housing assembly, a series of annular spaced nozzles operable when a predetermined charge of gaseous fuel under pressure from said gaseous fuel chamber means is communicated therewith to direct said charge into said annular mixing chamber in jet stream formations with said combustion chamber means open so that the jet stream formations are operable (1) to cause fresh air from said fresh air inlet means to be entrained and mixed with the charge of fuel forming the jet stream formations and (2) to cause the jet stream formations of fuel mixed with entrained air to flow from said mixing chamber into the open combustion chamber means and move sufficient residual gas in said combustion chamber means therethrough and into the atmosphere to fill the combustion chamber means with a charge of combustible gases in the form of an air-fuel mixture, means for igniting a charge of combustible gases in said combustion chamber means, and means operable in response to a predetermined manual actuating procedure for (1) causing a predetermined charge of gaseous fuel under pressure within said gaseous fuel chamber means supplied thereto from a source of fuel under pressure to be communicated with said series of nozzles so as to fill said combustion chamber means with a charge of combustible gases, (2) causing said main valve means to move from said open position into said closed position in timed relation to the filling of the combustion chamber means with the charge of combustible gases, and (3) causing said igniting means to ignite the charge of combustible gases in said combustion chamber means while the charge is at generally atmospheric pressure so as to create pressure conditions in said combustion chamber means in communication with said drive chamber sufficient to drive said drive piston and said fastener driving element through a drive stroke.

2. An internal combustion actuated portable tool as defined in claim 1 including piston return means for effecting successive return strokes of said drive piston, said piston return strokes comprising resilient bumper means disposed within said cylindrical chamber for engagement by said drive piston to define the position at which said drive piston reaches the end of a drive stroke and begins a return stroke and return stroke spring means mounted in said cylindrical chamber so as to be free of stress by the movement of said drive piston through a predetermined initial portion of the drive stroke thereof and to be progressively stressed by the movement of said drive piston through the remaining portion of each drive stroke following said predetermined initial portion so that the energy of the stressed return stroke spring means is operable to initiate a return stroke of said drive piston and to operative move said drive piston through an initial portion of the return strop such that the movement imparted to said drive piston during the initial portion of the return stroke is sufficient to enable the drive piston to complete the return stroke thereof.

3. An internal combustion actuated portable tool as defined in claim 2 wherein said main valve means includes first pressure surface means in communication with the pressure conditions within said combustion chamber means when said main valve means is in the closed portion thereof positioned such that the pressure within said combustion chamber means biases said main valve means into the closed position thereof, said main valve means having second pressure surface means thereon of an area greater than said first pressure surface means, means defining a pressure chamber communicating with said second pressure surface means in a position such that pressurized gas within said pressure chamber acts on said second pressure surface means to bias said main valve means from the closed position thereof toward the open position thereof, pressure chamber control means mounted in said housing assembly for movement between (1) an operative position wherein the pressure conditions within said cylindrical drive chamber acting on said drive piston are communicated with said pressure chamber and (2) an inoperative position wherein said pressure chamber is out of such communicating relation with said cylindrical drive chamber, said pressure chamber control means being mounted within said cylindrical drive chamber in a position to be (1) engageable with said return stroke spring means so as to be biased thereby toward the inoperative position thereof and (2) engageable with said drive piston during (A) the remaining portion of the drive stroke thereof so as to be moved thereby from the inoperative position thereof into the operative position thereof against the bias of said return stroke spring means and (B) the initial portion of the return stoke of said drive piston so as to effect the return stroke of said drive piston during the movement of said pressure chamber control member from the operative position thereof into the inoperative position thereof by said return stroke spring means.

4. An internal combustion actuated portable tool as defined in claim 1 wherein said actuating procedure responsive means comprises actuating valve means movable in response to said predetermined actuating procedure from (1) an inoperative position wherein a charge of gaseous fuel under pressure from a source of fuel under pressure is communicated with said fuel chamber means into (2) an operative position wherein the communication of the source of fuel under pressure with said fuel chamber means is closed off and said fuel chamber means is communicated with said nozzle means and valve moving means including timing means operable in response to the communication of the gaseous fuel chamber means with said nozzle means for causing said main valve means to be moved from the open position thereof into the closed position thereof in timed relation to the operation of said nozzle means with respect to said combustion chamber means.

5. An internal combustion actuated portable tool as defined in claim 4 wherein said valve moving means further includes first spring means for biasing said main valve means to move into the closed position thereof, second spring means of a strength greater than the strength of said first spring means, contact tip means mounted adjacent said workpiece engaging portion for movement (1) from an inoperative position wherein said second spring means is rendered operable to bias said main valve means into the open position thereof and (2) into an operative position in response to the engagement of said workpiece engaging portion with a workpiece wherein said second spring means is rendered inoperable to bias said main valve means into the open position thereof, said timing means including a timing cylinder forming a part of said gaseous fuel chamber means and a timing piston within said timing cylinder connected with said main valve means to move therewith, said timing piston presenting a differential pressure area acted on by the gaseous fuel under pressure within said timing cylinder so as to bias said timing piston and hence said main valve means into the open position thereof (1) with a bias sufficient to overcome the bias of said first spring means when the gaseous fuel pressure within said gaseous fuel chamber means is a regulated pressure by virtue of said actuating valve means being in its inoperative position and (2) with a bias which is progressively reduced so as to be progressively less than the bias of said first spring means when the gaseous fuel pressure within said gaseous fuel chamber means is communicated with said nozzle means by virtue of said actuating valve means being moved into the operative position thereof.

6. An internal combustion actuated portable tool as defined in claim 5 wherein said actuating valve means includes an actuating valve mounted within said housing assembly for movement between inoperative and operative positions, third spring means biasing said actuating valve into said operative position and an actuating valve moving member mounted for movement (1) from (A) an actuating valve retaining position wherein said actuating valve is retained thereby in the inoperative position thereof against the bias of said third spring means into (B) an actuating valve releasing position wherein said actuating valve is released so as to be biased by said third spring means into the operating position thereof and (2) from (A) said actuating valve releasing position into (B) an actuating valve engaging position in response to the movement of said main valve means from the open position thereof into the closed position thereof and (3) from (A) said actuating valve engaging position into (B) said actuating valve retaining position in motion transmitting relation with said actuating valve so as to move the actuating valve from the operative position thereof into the inoperative position thereof against the bias of said third spring means in response to the movement of said main valve means from the closed position thereof into the open position thereof.

7. An internal combustion actuated portable tool as defined in claim 6 wherein said predetermined actuating procedure comprises a (1) movement of said contact trip means into the operative position thereof and (2) a digital movement of a trigger member from an inoperative position thereof into an operative position thereof.

8. An internal combustion actuated portable tool as defined in claim 7 wherein said actuating member, said contact trip means and said trigger member have means operative associated therewith for (1) enabling said actuating valve moving member to be moved from the actuating valve retaining position thereof into the actuating valve releasing position thereof by the movement of said trigger member into the operative position thereof after said contact trip means has been moved into the operative position thereof and (2) preventing said actuating valve moving member from being moved from the actuating valve retaining position thereof into the actuating valve releasing position thereof by the digital movement of the trigger member from the inoperative position thereof into the operative position thereof before said contact trip means has been moved into the operative position thereof.

9. An internal combustion actuated portable tool as defined in claim 1 wherein said main body portion includes a fixed interior annular housing wall constituting the means defining said cylindrical drive chamber, said annular mixing chamber being defined interiorly by said fixed interior annular housing wall and having annularly spaced angularly oriented vanes therein below said combustion chamber for imparting a swirling movement to the fuel mixed with entrained air as it flows from said mixing chamber into the open combustion chamber means.

10. An internal combustion actuated portable tool as defined in claim 9 wherein one of said combustion chamber means includes one end defined by a fixed interior transverse wall forming an end profile of said housing main body portion which also includes a fixed exterior peripheral wall extending between said fixed transverse wall and said workpiece engaging portion in spaced surrounding relation to said fixed interior housing wall, said hollow handle portion being fixed to and extending from a central portion of said exterior peripheral wall.

11. An internal combustion actuated portable tool as defined in claim 10 wherein said valve structure includes an annular wall structure including one end portion defining the exterior periphery of said combustion chamber means, an adjacent portion disposed between the fixed exterior peripheral wall and the fixed interior annular wall of said housing assembly and defining the exterior periphery of said mixing chamber.

12. An internal combustion actuated portable tool as defined in claim 11 wherein the fixed exterior transverse wall of said housing assembly includes a fixed annular exhaust valve seating surface and the one end portion of said fixed interior annular housing wall includes an exterior cylindrical inlet valve seating surface, said annular wall structure having annular inlet valve means thereon for engaging said cylindrical inlet valve seating surface during a predetermined portion of the movement of said annular wall structure adjacent the closed position thereof and annular exhaust valve means for engaging said annular exhaust valve seating surface during a portion of the movement of said annular wall structure adjacent the closing position thereof less than said predetermined portion thereof.

13. An internal combustion actuated portable tool as defined in claim 10 wherein said main valve means includes a valve structure mounted within said housing assembly adjacent the fixed exterior peripheral wall thereof for movement between open and closed positions.

14. An internal combustion actuated portable tool as defined in claim 13 wherein said actuating procedure responsive means includes means for moving said valve structure between the open and closed positions thereof, said moving means including a timing cylinder within said gaseous fuel chamber means having one end communicating with said gaseous fuel chamber means so that gaseous fuel contained within said timing cylinder is also contained within said gaseous fuel chamber means, a timing piston slidably mounted in said timing cylinder for movement between extended and retracted positions, said timing piston having opposed surfaces one of which is always in communication with said one end of said timing cylinder, means for connecting said timing piston with said valve structure so that movement of said timing piston from said extended position to said retracted position corresponds with the movement of said valve structure from the closed position thereof to the open position thereof and movement of said timing piston from said retracted position to said extended position corresponds with the movement of said valve structure from the open position thereof to the closed position thereof, passage means in an opposite end of said timing cylinder for enabling the other surface of said timing piston to be at atmospheric pressure when said timing piston is in said retracted position so that the gaseous fuel pressure acting on said one surface biases said timing piston to remain in said retracted position and hence said valve structure to remain in the open position thereof, and valve spring means acting between said housing assembly and said valve structure for resiliently biasing said valve structure toward the closed position thereof with a bias which is less than the gaseous fuel bias when at a regulated contained pressure.

15. An internal combustion actuated portable tool as defined in claim 14 wherein said actuating procedure responsive means further includes a trigger member mounted on said housing assembly for movement between operative and inoperative positions by digital operation of a user grasping said handle portion, a contact trip member mounted on said workpiece engaging portion for movement between operative and inoperative positions by engagement with a workpiece when said workpiece engaging portion is moved into and out of engagement with the workpiece, an actuating valve member mounted within said housing assembly for movement between operative and inoperative positions, means cooperatively interconnecting said trigger member, said contact trip member and said actuating valve member so that said actuating valve member will be moved from the inoperative position thereof to the operative position when said trigger member and said contact trip member are both moved into the operative positions thereof in accordance with the predetermined actuating procedure, means for (1) communicating said fuel chamber means with said nozzle means when said actuating valve member is in the operative position thereof and (2) preventing communication of said fuel chamber means with said nozzle means when said actuating valve member is in the inoperative position thereof.

16. An internal combustion actuated portable tool as defined in claim 15 wherein said valve structure moving means further includes contact trip spring means acting between said housing assembly and said contact trip member for resiliently biasing said contact trip member into the inoperative position thereof and means for connecting said contact trip member with said valve structure so as (1) to enable said contact trip spring means to bias said valve structure into the open position thereof when said contact trip member is in the inoperative position thereof and (2) to prevent said contact trip spring means from biasing said valve structure when said contact trip member is in the operative position thereof, the spring force of said contact trip spring means when biasing said valve structure being greater than the oppositely biasing spring force of said valve spring means.

17. An internal combustion actuated portable tool as defined in claim 16 wherein said actuating procedure responsive means including fuel supply means within said housing assembly for receiving and operatively supporting a fuel supply therein in the form of a canister having liquid fuel under pressure therein in a condition such that fuel from said canister is continuously available, means defining a gaseous fuel supply space within said housing assembly, pressure regulating means for communicating fuel under pressure from a fuel supply operatively supported in said fuel supply means with said gaseous fuel supply space so as to maintain a supply of fuel in a gaseous form within said gaseous fuel supply space at a regulated contained pressure, and means operable (1) when said actuating valve member is in the inoperative position thereof for (A) communicating said gaseous fuel chamber means with said gaseous fuel supply space and (B) preventing communication of said gaseous fuel chamber means with said nozzle means and (2) when said actuating valve member is in the operative position thereof for (A) communicating said gaseous fuel chamber means with said nozzle means and (B) preventing communication between said gaseous fuel chamber means and said gaseous fuel supply space.

18. An internal combustion actuated portable tool as defined in claim 17 wherein said actuating procedure responsive means includes piezoelectric means operable in response to an engagement thereof for electrically actuating said ignition means and means for engaging said piezoelectric means in response to the movement of said valve structure into the closed position thereof.

19. An internal combustion actuated portable tool as defined in claim 16 including piston return means for effecting successive return strokes of said drive piston, said piston return means comprising resilient bumper means disposed within said cylindrical chamber for engagement by said drive piston to define the position at which said drive piston reaches the end of a drive stroke and begins a return stroke and return stroke spring means mounted in said cylindrical chamber so as to be free of stress by the movement of said drive piston through a predetermined initial portion of the drive stroke thereof and to be progressively stressed by the movement of said drive piston through the remaining portion of each drive stroke following said predetermined initial portion so that the energy of the stressed return stroke spring means is operable to initiate a return stroke of said drive piston and to operatively move said drive piston through an initial portion of the return stroke such that the movement imparted to said drive piston during the initial portion of the return stroke is sufficient to enable the drive piston to complete the return stroke thereof.

20. An internal combustion actuated portable tool as defined in claim 19 wherein said valve structure includes a first pressure surface in communication with the pressure conditions within said combustion chamber means when said valve structure is in the closed position thereof positioned such that the pressure within said combustion chamber means biases said valve structure into the closed position thereof, said valve structure having a second pressure surface thereon of an area greater than said first pressure surface, means defining a pressure chamber communicating with said second pressure surface in a position such that a pressurized gas within said pressure chamber acts on said second pressure surface to bias said valve structure from the closed position thereof toward the open position thereof, a pressure chamber control member mounted in said housing assembly for movement between (1) an operative position wherein the pressure condition within said cylindrical drive chamber acting on said drive piston is communicated with said pressure chamber and (2) an inoperative position wherein said pressure chamber is out of such communicating relation with said cylindrical drive chamber, said pressure chamber control member being mounted within said cylindrical drive chamber in a position to be (1) engageable with said return stroke spring means so as to be biased thereby toward the inoperative position thereof and (2) engageable with said drive piston during (A) the remaining portion of the drive stroke thereof so as to be moved thereby from the inoperative position thereof into the operative position thereof against the bias of said return stroke spring means and (B) the initial portion of the return stroke of said drive piston so as to effect the return stroke of said drive piston during the movement of said pressure chamber control member from the operative position thereof into the inoperative position thereof by said return stroke spring means.

21. An internal combustion actuated portable tool as defined in claim 16 wherein said cooperatively interconnecting means includes an actuating valve moving member mounted (1) for movement with said valve structure from an actuating valve engaging position into an actuating valve retaining position when said valve structure moves from the closed position thereof to the open position thereof (2) for movement with respect to said valve structure from said actuating valve retaining position into an actuating valve releasing position, and (3) for movement with said valve structure from said actuating valve releasing position into said actuating valve engaging position when said valve structure moves from the open position thereof to the closed position thereof, actuating valve spring means for resiliently biasing said actuating valve member into the operative position thereof and means acting between said actuating valve member and said actuating valve moving member for (1) enabling the movement of said actuating valve moving member from the valve engaging position thereof to the valve retaining position thereof to move said actuating valve member from the operative position thereof to the inoperative position thereof against the bias of said actuating valve spring means and (2) enabling the movement of said actuating valve moving member from the valve retaining position thereof into the valve releasing position thereof to enable said actuating valve spring means to move said actuating valve member from the inoperative position thereof into the operative position thereof.

22. An internal combustion actuated portable tool as defined in claim 21 wherein said cooperatively interconnecting means further includes first abutment means movable carried by said trigger member for effecting movement of said actuating valve moving member from the actuating valve retaining position thereof into the actuating valve releasing position thereof in response to the movement of said trigger member from the inoperative position thereof into the operative position thereof when said contact trip member is in the operative position thereof and second abutment means movably carried by said housing assembly for preventing movement of said trigger member from the inoperative position thereof into the operative position thereof when said contact trip member is in the inoperative position thereof.

23. An internal combustion actuated portable tool as defined in claim 22 wherein said first abutment means comprises a first lever pivoted on said trigger member for movement from a normally biased inoperative position into an operative position, said first lever being normally biased into said operative position and being operable therein to engage said actuating valve moving member and move the same from the actuating valve retaining position thereof into the actuating valve releasing position thereof in response to the movement of the trigger member from the inoperative position thereof into the operative position thereof, said first lever being movable from the operative position thereof into the inoperative position thereof against the normal bias thereof when said trigger member is in the operative position thereof by the movement of said actuating valve moving member from the actuating valve engaging position thereof into the actuating valve retaining position thereof.

24. An internal combustion actuated portable tool as defined in claim 23 wherein said second abutment means includes a second lever pivoted to said housing assembly for movement between an inoperative position with respect to said trigger member and an operative position into which said second lever is normally biased and in which said second lever is operable to prevent movement of said trigger member from the inoperative position thereof into the operative position thereof, said second lever being movable from the operative position thereof into the inoperative position thereof in response to the movement of said contact trip member from the inoperative position thereof into the operative position thereof.

25. An internal combustion actuated portable tool comprising a housing assembly including a main body portion having means defining a cylindrical drive chamber therein and a handle portion extending from said main body portion for enabling a user to manually move the housing assembly in portable fashion, a drive piston slidably sealingly mounted in said cylindrical drive chamber for movement through repetitive cycles each of which includes a drive stroke and a return stroke, combustion chamber means operatively associated with said drive chamber within the main body portion of said housing assembly, gaseous fuel chamber means for containing a gaseous fuel component of a charge of combustible gases, main valve means mounted in said housing assembly for movement between (1) an open position wherein a combusted charge of combustible gases can be removed from said combustion chamber means for replacement by a charge of combustible gases therein and (2) a closed position wherein a charge of combustible gases can be contained and combusted within said combustion chamber means to effect a drive stroke of said drive piston within said cylindrical chamber, means for igniting a charge of combustible gases within said combustion chamber means, and means operable in response to a predetermined manual actuating procedure for causing said igniting means to ignite a charge of combustible gases contained within said combustion chamber means by said main valve means in the closed position thereof, said actuating procedure responsive means including actuating valve means mounted on said housing assembly for movement from an inoperative position into an operative position in response to the performance of said predetermined manual actuating procedure, fuel supply means within said housing assembly for receiving and operatively supporting a fuel supply therein in the form of a canister having liquid fuel under pressure therein in a condition such that fuel from said canister is continuously available, means defining a gaseous fuel supply space within said housing assembly, and pressure regulating means for communicating fuel under pressure from a fuel supply operatively supported in said fuel supply means with said gaseous fuel supply space so as to maintain a supply of fuel in a gaseous form within said gaseous fuel supply space at a regulated contained pressure, said actuating valve means being operable (1) when in the inoperative position thereof to (A) communicate said gaseous fuel chamber means with said gaseous fuel supply space and (B) prevent communication of said gaseous fuel chamber means with said combustion chamber means and (2) when in the operative position thereof to (A) communicate said gaseous fuel chamber means with said combustion chamber means and (B) prevent communication between said gaseous fuel chamber means and said gaseous fuel supply space.

26. An internal combustion actuated portable tool as defined in claim 25 wherein said fuel supply means and said fuel supply space are within said handle portion.

27. An internal combustion actuated portable tool as defined in claim 26 wherein said gaseous fuel supply space has a volume greater than twice the volume of said gaseous fuel chamber means.

28. An internal combustion actuated portable tool as defined in claim 25 wherein said main valve means includes a valve structure mounted within said housing assembly for movement between open and closed positions, said actuating procedure responsive means including means for moving said valve between the open and closed positions thereof, said moving means including a timing cylinder within said gaseous fuel chamber means having one end communicating with said gaseous fuel chamber means so that gaseous fuel contained within said timing cylinder is also contained within said gaseous fuel chamber means, a timing piston slidably mounted in said timing cylinder for movement between extended and retracted positions, said timing piston having opposed surfaces one of which is always in communication with said one end of said timing cylinder, means for connecting said timing piston with said valve structure so that movement of said timing piston from said extended position to said retracted position corresponds with the movement of said valve structure from the closed position thereof to the open position thereof and movement of said timing piston from said retracted position to said extended position corresponds with the movement of said valve structure from the open position thereof to the closed position thereof, passage means in an opposite end of said timing cylinder for enabling the other surface of said timing piston to be at atmospheric pressure when said timing piston is in said retracted position so that the gaseous fuel pressure acting on said one surface biases said timing piston to remain in said retracted position and hence said valve structure to remain in the open position thereof, and valve spring means acting between said housing assembly and said valve structure for resiliently biasing said valve structure toward the closed position thereof with a bias which is less than the gaseous fuel bias when at a regulated contained pressure.

29. An internal combustion actuated portable tool as defined in claim 25 wherein said actuating valve means includes an actuating valve mounted within said housing assembly for movement between inoperative and operative positions, actuating valve spring means biasing said actuating valve into said operative position and an actuating valve moving member mounted for movement (1) from (A) an actuating valve retaining position wherein said actuating valve is retained thereby in the inoperative position thereof against the bias of said third spring means into (B) an actuating valve releasing position wherein said actuating valve is released so as to be biased by said actuating valve spring means into the operating position thereof and (2) from (A) said actuating valve releasing position into (B) an actuating valve engaging position in response to the movement of said main valve means from the open position thereof into the closed position thereof and (3) from (A) said actuating valve engaging position into (B) said actuating valve retaining position in motion transmitting relation with said actuating valve so as to move the actuating valve from the operative position thereof into the inoperative position thereof against the bias of said actuating valve spring means in response to the movement of said main valve means from the closed position thereof into the open position thereof.

30. An internal combustion actuated portable tool as defined in claim 29 including piston return means for effecting successive return strokes of said drive piston, said piston return means comprising resilient bumper means disposed within said cylindrical chamber for engagement by said drive piston to define the position at which said drive piston reaches the end of a drive stroke and begins a return stroke and return stroke spring means mounted in said cylindrical chamber so as to be free of stress by the movement of said drive piston through a predetermined initial portion of the drive stroke thereof and to be progressively stressed by the movement of said drive piston through the remaining portion of each drive stroke following said predetermined initial portion so that the energy of the stressed return stroke spring means is operable to initiate a return stroke of said drive piston and to operatively move said drive piston through an initial portion of the return stroke such that the movement imparted to said drive piston during the initial portion of the return stroke is sufficient to enable the drive piston to complete the return stroke thereof.

31. An internal combustion actuated portable tool as defined in claim 30 wherein said valve structure includes a first pressure surface in communication with the pressure conditions within said combustion chamber means when said valve structure is in the closed position thereof positioned such that the pressure within said combustion chamber means biases said valve structure into the closed position thereof, said valve structure having a second pressure surface thereon of an area greater than said first pressure surface, means defining a pressure chamber communicating with said second pressure surface in a position such that a pressurized gas within said pressure chamber acts on said second pressure surface to bias said valve structure from the closed position thereof toward the open position thereof, a pressure chamber control member mounted in said housing assembly for movement between (1) an operative position wherein the pressure conditions within said cylindrical chamber acting on said drive piston are communicated with said pressure chamber and (2) an inoperative position wherein said pressure chamber is out of such communicating relation with said cylindrical chamber, said pressure chamber control member being mounted within said cylindrical chamber in a position to be (1) engageable with said return stroke spring means so as to be biased thereby toward the inoperative position thereof and (2) engageable with said drive piston during (A) the remaining portion of the drive stroke thereof so as to be moved thereby from the inoperative position thereof into the operative position thereof against the bias of said return stroke spring means and (B) the initial portion of the return stroke of said drive piston so as to effect the return stroke of said drive piston during the movement of said pressure chamber control member from the operative position thereof into the inoperative position thereof by said return stroke spring means.

32. An internal combustion actuated portable tool as defined in claim 25 wherein said actuating valve means includes an actuating valve mounted within said housing assembly for movement between inoperative and operative positions, actuating valve spring means biasing said actuating valve into said operative position and an actuating valve moving member mounted for movement (1) from (A) an actuating valve retaining position wherein said actuating valve is retained thereby in the inoperative position thereof against the bias of said third spring means into (B) an actuating valve releasing position wherein said actuating valve is released so as to be biased by said actuating valve spring means into the operating position thereof and (2) from (A) said actuating valve releasing position into (B) an actuating valve engaging position in response to the movement of said main valve means from the open position thereof into the closed position thereof and (3) from (A) said actuating valve engaging position into (B) said actuating valve retaining position in motion transmitting relation with said actuating valve so as to move the actuating valve from the operative position thereof into the inoperative position thereof against the bias of said actuating valve spring means in response to the movement of said main valve means from the closed position thereof into the open position thereof.

33. An internal combustion actuated portable tool as defined in claim 25 including piston return means for effecting successive return strokes of said drive piston, said piston return means comprising resilient bumper means disposed within said cylindrical chamber for engagement by said drive piston to define the position at which said drive piston reaches the end of a drive stroke and begins a return stroke and return stroke spring means mounted in said cylindrical chamber so as to be free of stress by the movement of said drive piston through a predetermined initial portion of the drive stroke thereof and to be progressively stressed by the movement of said drive piston through the remaining portion of each drive stroke following said predetermined initial portion so that the energy of the stressed return stroke spring means is operable to initiate a return stroke of said drive piston and to operatively move said drive piston through an initial portion of the return stroke such that the movement imparted to said drive piston during the initial portion of the return stroke is sufficient to enable the drive piston to complete the return stroke thereof.

34. An internal combustion actuated portable tool as defined in claim 33 wherein said main valve means includes first pressure surface means in communication with the pressure conditions within said cylindrical chamber when said main valve means is in the closed position thereof positioned such that the pressure within said combustion chamber means biases said valve structure into the closed position thereof, said main valve means having a second pressure surface means thereon of an area greater than said first pressure surface means, communicating with said second pressure surface means in a position such that pressurized gas within said pressure chamber acts on said second pressure surface means to bias said valve structure from the closed position thereof toward the open position thereof, a pressure chamber control member mounted in said housing assembly for movement between (1) an operative position wherein pressure condition within said cylindrical chamber acting on said drive piston is communicated with said pressure chamber and (2) an inoperative position wherein said pressure chamber is out of such communicating relation with said cylindrical chamber, said pressure chamber control member being mounted within said cylindrical chamber in a position to be (1) engageable with said return stroke spring means so as to be biased thereby toward the inoperative position thereof and (2) engageable with said drive piston during (A) the remaining portion of the drive stroke thereof so as to be moved thereby from the inoperative position thereof into the operative position thereof against the bias of said return stroke spring means and (B) the initial portion of the return stroke of said drive piston so as to effect the return stroke of said drive piston during the movement of said pressure chamber control member from the operative position thereof into the inoperative position thereof by said return stroke spring means.

35. An internal combustion actuated portable tool as defined in claim 25 wherein said actuating procedure responsive means includes piezoelectric means operable in response to an engagement thereof for electrically actuating said ignition means and means for engaging said piezoelectric means in response to the movement of said valve structure into the closed position thereof.

36. An internal combustion actuated portable tool comprising a housing assembly including a workpiece engaging portion having means defining a fastener drive track therein, a main body portion adjacent said workpiece engaging portion defining an acceptable housing profile and having means defining a cylindrical drive chamber therein and a handle portion extending transversely from said main body portion for enabling a user to manually move the housing assembly in portable fashion, a drive piston slidably sealingly mounted in said cylindrical drive chamber for movement through repetitive cycles each of which includes a drive stroke and a return stroke, a fastener driving element operatively connected with said piston and mounted in said fastener drive track for movement therein through a drive stroke in response to the drive stroke of said piston and a return stroke in response to the return stroke of said piston, magazine means carried by said housing assembly for containing a supply of fasteners and feeding successive leading fasteners of the supply into said fastener drive track to be driven therefrom by said fastener driving element during the drive stroke thereof, combustion chamber means operatively associated with said drive chamber within the acceptable profile defining portion of said housing assembly, gaseous fuel chamber means for containing a gaseous fuel component of a charge of combustible gases, main valve means mounted in said housing assembly for movement between (1) an open position wherein a combusted charge of combustible gases can be removed from said combustion chamber means for replacement by a charge of combustible gases therein and (2) a closed position wherein a charge of combustible gases can be contained and combusted within said combustion chamber means to effect a drive stroke of said drive piston within said cylindrical chamber, means for igniting a charge of combustible gases within said combustion chamber means, and means operable in response to a predetermined manual actuating procedure for causing said igniting means to ignite a charge of combustible gases contained within said combustion chamber means by said main valve means in the closed position thereof, said actuating procedure responsive means including actuating valve means mounted on said housing assembly for movement from an inoperative position into an operative position in response to the performance of said predetermined manual actuating procedure, fuel supply means within said housing assembly for receiving and operatively supporting a fuel supply therein in the form of a canister having liquid fuel under pressure therein in a condition such that fuel from said canister is continuously available, means defining a gaseous fuel supply space within said housing assembly, and pressure regulating means for communicating fuel under pressure from a fuel supply operatively supported in said fuel supply means with said gaseous fuel supply space so as to maintain a supply of fuel in a gaseous form within said gaseous fuel supply space at a regulated contained pressure, said actuating valve means being operable (1) when in the inoperative position thereof to (A) communicate said gaseous fuel chamber means with said gaseous fuel supply space and (B) prevent communication of said gaseous fuel chamber means with said combustion chamber means and (2) when in the operative position thereof to (A) communicate said gaseous fuel chamber means with said combustion chamber means and (B) prevent communication between said gaseous fuel chamber means and said gaseous fuel supply space.

37. An internal combustion actuated portable tool as defined in claim 36 wherein said gaseous fuel supply space has a volume greater than the volume of said gaseous fuel chamber means.

38. An internal combustion actuated portable tool as defined in claim 37 wherein the volume of said gaseous fuel supply space is greater than twice the volume of said gaseous fuel chamber means.

39. An internal combustion actuated portable tool as defined in claim 38 wherein said handle portion includes a hand grip section, said fuel supply space comprising an elongated chamber within said hand grip section.

40. An internal combustion actuated portable tool as defined in claim 36 wherein said actuating procedure responsive means further includes a trigger member mounted on said housing assembly for movement between operative and inoperative positions by digital operation of a user grasping said handle portion, a contact trip member mounted on said workpiece engaging portion for movement between operative and inoperative positions by engagement with a workpiece when said workpiece engaging portion is moved into and out of engagement with the workpiece, said actuating valve means including an actuating valve member mounted within said housing assembly for movement between operative and inoperative positions, means cooperatively interconnecting said trigger member, said contact trip member and said actuating valve member so that said actuating valve member will be moved from the inoperative position thereof to the operative position when said trigger member and said contact trip member are both moved into the operative positions thereof in accordance with the predetermined actuating procedure, means for (1) communicating said fuel chamber means with said combustion chamber means when said actuating valve member is in the operative position thereof and (2) preventing communication of said fuel chamber means with said combustion chamber means when said actuating valve member is in the inoperative position thereof.

41. An internal combustion actuated portable tool as defined in claim 40 wherein said actuating procedure responsive means includes piezoelectric means operable in response to an engagement thereof for electrically actuating said ignition means and means for engaging said piezoelectric means in response to the movement of said main valve means into the closed position thereof.

42. An internal combustion actuated portable tool as defined in claim 40 wherein said actuating procedure responsive means comprises main valve moving means for moving said main valve means between the closed and open positions thereof, said main valve moving means comprising first spring means for biasing said main valve means to move into the closed position thereof, second spring means of a strength greater than the strength of said first spring means operatively connected with said contact trip member so that (1) when said contact trip member is in the inoperative position thereof said second spring means is rendered operable to bias said main valve means into the open position thereof and (2) when said contact trip member is in the operative position thereof said second spring means is rendered inoperable to bias said main valve means into the open position thereof, including a timing cylinder forming a part of said gaseous fuel chamber means and a timing piston within said timing cylinder connected with said main valve means to move therewith, said timing piston presenting a differential pressure area acted on by the gaseous fuel under pressure within said timing cylinder so as to bias said timing piston and hence said main valve means into the open position thereof (1) with a bias sufficient to overcome the bias of said first spring means when the gaseous fuel pressure within said gaseous fuel chamber means is a container pressure by virtue of said actuating valve means being in its inoperative position and (2) with a bias which is progressively reduced so as to be progressively less than the bias of said first spring means when the gaseous fuel pressure within said gaseous fuel chamber means is communicated with said nozzle means by virtue of said actuating valve means being moved into the operative position thereof.

43. An internal combustion actuated portable tool as defined in claim 42 including piston return means for effecting successive return strokes of said drive piston, said piston return means comprising resilient bumper means disposed within said cylindrical chamber for engagement by said drive piston to define the position at which said drive piston reaches the end of a drive stroke and begins a return stroke and return stroke spring means mounted in said cylindrical chamber so as to be free of stress by the movement of said drive piston through a predetermined initial portion of the drive stroke thereof and to be progressively stressed by the movement of said drive piston through the remaining portion of each drive stroke following said predetermined initial portion so that the energy of the stressed return stroke spring means is operable to initiate a return stroke of said drive piston and to operatively move said drive piston through an initial portion of the return stroke such that the movement imparted to said drive piston during the initial portion of the return stroke is sufficient to enable the drive piston to complete the return stroke thereof.

44. An internal combustion actuated portable tool as defined in claim 43 wherein said main valve moving means includes first pressure surface means on said main valve means in communication with the pressure conditions within said combustion chamber means when said main valve means is in the closed position thereof positioned such that the pressure within said combustion chamber means biases said main valve means into the closed position thereof, said main valve means having second pressure surface means thereon of an area greater than said first pressure surface means, means defining a pressure chamber communicating with said second pressure surface means in a position such that pressurized gas within said pressure chamber acts on said second pressure surface means to bias said main valve means from the closed position thereof toward the open position thereof, pressure chamber control means mounted in said housing assembly for movement between (1) an operative position wherein the pressure conditions within said cylindrical chamber acting on said drive piston are communicated with said pressure chamber and (2) an inoperative position wherein said pressure chamber is out of such communicating relation with said cylindrical chamber, said pressure chamber control means being mounted within said cylindrical chamber in a position to be (1) engageable with said return stroke spring means so as to be biased thereby toward the inoperative position thereof and (2) engageable with said drive piston during (A) the remaining portion of the drive stroke thereof so as to be moved thereby from the inoperative position thereof into the operative position thereof against the bias of said return stroke spring means and (B) the initial portion of the return stroke of said drive piston so as to effect the return stroke of said drive piston during the movement of said pressure chamber control member from the operative position thereof into the inoperative position thereof by said return stroke spring means.

45. An internal combustion actuated portable tool as defined in claim 40 wherein said cooperatively interconnecting means includes an actuating valve moving member mounted (1) for movement with said valve structure from an actuating valve engaging position into an actuating valve retaining position when said valve structure moves from the closed position thereof to the open position thereof (2) for movement with respect to said valve structure from said actuating valve retaining position into an actuating valve releasing position, and (3) for movement with said main valve means from said actuating valve releasing position into said actuating valve engaging position when said valve means moves from the open position thereof to the closed position thereof, actuating valve spring means for resiliently biasing said actuating valve member into the operative position thereof and means acting between said actuating valve member and said actuating valve moving member for (1) enabling the movement of said actuating valve moving member from the valve engaging position thereof to the valve retaining position thereof to move said actuating valve member from the operative position thereof to the inoperative position thereof against the bias of said actuating valve spring means and (2) enabling the movement of said actuating valve moving member from the valve retaining position thereof into the valve releasing position thereof to enable said actuating valve spring means to move said actuating valve member from the inoperative position thereof into the operative position thereof.

46. An internal combustion actuated portable tool as defined in claim 45 wherein said cooperatively interconnecting means further includes first abutment means movable carried by said trigger member for effecting movement of said actuating valve moving member from the actuating valve retaining position thereof into the actuating valve releasing position thereof in response to the movement of said trigger member from the inoperative position thereof into the operative position thereof when said contact trip member is in the operative position thereof and second abutment means movable carried by said housing assembly for preventing movement of said trigger member from the inoperative position thereof into the operative position thereof when said contact trip member is in the inoperative position thereof.

47. An internal combustion actuated portable tool as defined in claim 46 wherein said first abutment means comprises a first lever pivoted on said trigger member for movement between inoperative and operative positions, said first lever being normally biased into said operative position and being operable therein to engage said actuating valve moving member and move the same from the actuating valve retaining position thereof into the actuating valve releasing position thereof in response to the movement of the trigger member from the inoperative position thereof into the operative position thereof, said first lever being movable from the operative position thereof into the inoperative position thereof against the normal bias thereof when said trigger member is in the operative position thereof by the movement of said actuating valve moving member from the actuating valve engaging position thereof into the actuating valve retaining position thereof.

48. An internal combustion actuated portable tool as defined in claim 47 wherein said second abutment means includes a second lever pivoted to said housing assembly for movement between an inoperative position with respect to said trigger member and an operative position into which said second lever is normally biased and in which said second lever is operable to prevent movement of said trigger member from the inoperative position thereof into the operative position thereof, said second lever being movable from the operative position thereof into the inoperative position thereof in response to the movement of said contact trip member from the inoperative position thereof into the operative position thereof.

49. An internal combustion actuated portable tool comprising a housing assembly including a main body portion having means defining a cylindrical drive chamber therein and a handle portion extending from said main body portion for enabling a user to manually move the housing assembly in portable fashion, a drive piston slidably sealingly mounted in said cylindrical drive chamber for movement through repetitive cycles each of which includes a drive stroke and a return stroke, combustion chamber means operatively associated with said drive chamber within the main body portion of said housing assembly, mixing chamber means within said housing assembly in a position adjacent said combustion chamber means, fresh air inlet means communicating with said mixing chamber means within said housing assembly, main valve means moveable between (1) an open position wherein said combustion chamber means is open at a position of adjacent communication with said mixing chamber means and at a spaced position of communication with the atmosphere and (2) a closed position wherein said combustion chamber means is closed from communication with said mixing chamber means and the atmosphere, gaseous fuel chamber means within said housing assembly, nozzle means operable when a predetermined charge of gaseous fuel under pressure from said gaseous fuel chamber means is communicated therewith to direct said charge into said mixing chamber means in jet stream formation with said combustion chamber means open so that the jet stream formation is operable (1) to cause fresh air from said fresh air inlet means to be entrained and mixed with the charge of fuel forming the jet stream formation and (2) to cause the jet stream formation of fuel mixed with entrained air to flow from said mixing chamber means into the open combustion chamber means and move sufficient residual gas in said combustion chamber means therethrough and into the atmosphere to fill the combustion chamber means with a charge of combustible gases in the form of an air-fuel mixture, means for igniting a charge of combustible gases in said combustion chamber means, and means operable in response to a predetermined manual actuating procedure for (1) causing a predetermined charge of gaseous fuel under a predetermined initial pressure within said gaseous fuel chamber means supplied thereto from a source of fuel under pressure to be communicated with said nozzle means so as to be directed therefrom as aforesaid as a result of which the pressure of the charge of gaseous fuel communicated therewith diminishes, (2) causing said main valve means to move from said open position in response to the pressure of the gaseous fuel communicating with said nozzle means reaching a predetermined diminished pressure so that said main valve means reaches the closed position thereof in timed relation to the filling of the combustion chamber means with the charge of combustible gases, and (3) causing said igniting means to ignite the charge of combustible gases in said combustion chamber means while the charge is at generally atmospheric pressure.

50. An internal combustion actuated portable tool as defined in claim 49 wherein said nozzle means comprises a plurality of nozzle spaced exteriorly annularly about said cylindrical chamber in axially spaced relation with respect to the open end thereof, each of said nozzles being positioned to direct a jet stream of gaseous fuel under pressure through said annular mixing chamber in a direction toward said annular inlet opening.

51. An internal combustion actuated portable tool as defined in claim 49 wherein said actuating procedure responsive means includes a timing piston and means mounting said timing piston for (1) movement with said main valve means through a timing stroke during the movement of said main valve means from the open position to the closed position thereof and through a return stroke during the movement of said main valve means from the closed position to the open position thereof and (2) for bias by gaseous fuel under pressure in said gaseous fuel chamber in a direction to bias said main valve means toward the open position thereof and main valve spring means for resiliently biasing said main valve means toward the closed position thereof, the bias of said main valve spring means when said main valve means is in said closed position being (1) insufficient to overcome the opposite bias of &he gaseous fuel under pressure on said timing piston when at said initial predetermined pressure and (2) sufficient to overcome the opposite bias of the gaseous fuel under pressure on said timing piston when at said predetermined diminished pressure.

52. An internal combustion actuated portable tool as defined in claim 51 wherein said actuating procedure responsive means further includes actuating valve means mounted on said housing assembly for movement from an inoperative position into an operative position in response to the performance of said predetermined manual actuating procedure, said actuating valve means being operable (1) when in the inoperative position thereof to prevent communication of said gaseous fuel chamber means with said nozzle means and (2) when in the operative position thereof to communicate said gaseous fuel chamber means with said nozzle means.

53. An internal combustion actuated portable tool as defined in claim 52 wherein said actuating valve means includes an actuating valve mounted within said housing assembly for movement between inoperative and operative positions, actuating valve spring means biasing said actuating valve into said operative position and an actuating valve moving member mounted for movement (1) from (A) an actuating valve retaining position wherein said actuating valve is retained thereby in the inoperative position thereof against the bias of said third spring means into (B) an actuating valve releasing position wherein said actuating valve is released so as to be biased by said actuating valve spring means into the operating position thereof and (2) from (A) said actuating valve releasing position into (B) an actuating valve engaging position in response to the movement of said main valve means from the open position thereof into the closed position thereof and (3) from (A) said actuating valve engaging position into (B) said actuating valve retaining position in motion transmitting relation with said actuating valve so as to move the actuating valve from the operative position thereof into the inoperative position thereof against the bias of said actuating valve spring means in response to the movement of said main valve means from the closed position thereof into the open position thereof.

54. An internal combustion actuated portable tool as defined in claim 53 including piston return means for effecting successive return strokes of said drive piston, said piston return means comprising resilient bumper means disposed within said cylindrical chamber for engagement by said drive piston to define the position at which said drive piston reaches the end of a drive stroke and begins a return stroke and return stroke spring means mounted in said cylindrical chamber so as to be free of stress by the movement of said drive piston through a predetermined initial portion of the drive stroke thereof and to be progressively stressed by the movement of said drive piston through the remaining portion of each drive stroke following said predetermined initial portion so that the energy of the stressed return stroke spring means is operable to initiate a return stroke of said drive piston and to operatively move said drive piston through an initial portion of the return stroke such that the movement imparted to said drive piston during the initial portion of the return stroke is sufficient to enable the drive piston to complete the return stroke thereof.

55. An internal combustion actuated portable tool as defined in claim 54 wherein said main valve means includes first pressure surface means in communication with the pressure conditions within said combustion chamber means when said main valve means is in the closed position thereof positioned such that the pressure within said combustion chamber means biases said main valve means into the closed position thereof, said main valve means having second pressure surface means thereon of an area greater than said first pressure surface means, means defining a pressure chamber communicating with said second pressure surface means in a position such that a pressurized gas within said pressure chamber acts on said second pressure surface means to bias said main valve means from the closed position thereof toward the open position thereof, pressure chamber control means mounted in said housing assembly for movement between (1) an operative position wherein the pressure conditions within said cylindrical chamber acting on said drive piston are communicated with said pressure chamber and (2) an inoperative position wherein said pressure chamber is out of such communicating relation with said cylindrical chamber, said pressure chamber control means being mounted within said cylindrical chamber in a position to be (1) engageable with said return stroke spring means so as to be biased thereby toward the inoperative position thereof and (2) engageable with said drive piston during (A) the remaining portion of the drive stroke thereof so as to be moved thereby from the inoperative position thereof into the operative position thereof against the bias of said return stroke spring means and (B) the initial portion of the return stroke of said drive piston so as to effect with said resilient bumper means the return stroke of said drive piston during the movement of said pressure chamber control member from the operative position thereof into the inoperative position thereof by said return stroke spring means.

56. An internal combustion actuated portable tool as defined in claim 51 wherein said housing assembly includes a nosepiece portion having means defining a fastener drive track therein, a fastener driving element mounted in said drive track for movement with said drive piston through repetitive cycles each of which includes a drive stroke and a return stroke, fastener magazine means for containing a supply of fasteners and feeding successive fasteners into said drive track for movement outwardly thereof during successive drive strokes of said fastener driving element, said actuating procedure responsive means including a contact trip member mounted on said nosepiece portion for movement between inoperative and operative positions, contact trip spring means acting between said housing assembly and said contact trip member for resiliently biasing said contact trip member into the inoperative position thereof and means for connecting said contact trip member with said main valve means so as (1) to enable said contact trip spring means to bias said main valve means into the open position thereof when said contact trip member is in the inoperative position thereof and (2) to prevent said contact trip spring means from biasing said main valve means when said contact trip member is in the operative position thereof, the spring force of said contact trip spring means when biasing said main valve means being greater than the oppositely biasing spring force of said main valve spring means.

57. An internal combustion actuated portable tool as defined in claim 56 wherein said actuating procedure responsive means includes a timing cylinder within said gaseous fuel chamber means having one end communicating with said gaseous fuel chamber means so that the gaseous fuel contained within said timing cylinder is also contained within said gaseous fuel chamber means, said timing piston being slidably mounted in said timing cylinder for movement through said timing and return strokes, said timing piston having opposed surfaces one of which is always in communications with said one end of said timing cylinder, passage means in an opposite end of said timing cylinder for enabling the other surface of said timing piston to be at atmospheric pressure when said timing piston is in said retracted position so that the gaseous fuel pressure acting on said one surface biases said timing piston to remain in said retracted position and hence said main valve means to remain in the open position thereof.

58. An internal combustion actuated portable tool as defined in claim 56 including piston return means for effecting successive return strokes of said drive piston, said piston return means comprising resilient bumper means disposed within said cylindrical chamber for engagement by said drive piston to define the position at which said drive piston reaches the end of a drive stroke and begins a return stroke and return stroke spring means mounted in said cylindrical chamber so as to be free of stress by the movement of said drive piston through a predetermined initial portion of the drive stroke thereof and to be progressively stressed by the movement of said drive piston through the remaining portion of each drive stroke following said predetermined initial portion so that the energy of the stressed return stroke spring means together with said resilient bumper means is operable to initiate a return stroke of said drive piston and to operatively move said drive piston through an initial portion of the return stroke such that the movement imparted to said drive piston during the initial portion of the return stroke is sufficient to enable the drive piston to complete the return stroke thereof.

59. An internal combustion actuated portable tool as defined in claim 58 wherein said main valve means includes first pressure surface means in communication with the pressure conditions within said combustion chamber means when said main valve means is in the closed position thereof positioned such that the pressure within said combustion chamber means biases said main valve means into the closed position thereof, said main valve means having second pressure surface means thereon of an area greater than said first pressure surface means, means defining a pressure chamber communicating with said second pressure surface means in a position such that a pressurized gas within said pressure chamber acts on said second pressure surface means to bias said main valve means from the closed position thereof toward the open position thereof, pressure chamber control means mounted in said housing assembly for movement between (1) an operative position wherein the pressure conditions within said cylindrical chamber acting on said drive piston are communicated with said pressure chamber and (2) an inoperative position wherein said pressure chamber is out of such communicating relation with said cylindrical chamber, said pressure chamber control means being mounted within said cylindrical chamber in a position to be (1) engageable with said return stroke spring means so as to be biased thereby toward the inoperative position thereof and (2) engageable with said drive piston during (A) the remaining portion of the drive stroke thereof so as to be moved thereby from the inoperative position thereof into the operative position thereof against the bias of said return stroke spring means and (B) the initial portion of the return stroke of said drive piston so as to effect with said resilient bumper means the return stroke of said drive piston during the movement of said pressure chamber control member from the operative position thereof into the inoperative position thereof by said return stroke spring means.

60. An internal combustion actuated portable tool as defined in claim 59 wherein said actuating procedure responsive means further includes actuating valve means mounted on said housing assembly for movement from an inoperative position into an operative position in response to the performance of said predetermined manual actuating procedure, said actuating valve means being operable (1) when in the inoperative position thereof to prevent communication of said gaseous fuel chamber means with said nozzle means and (2) when in the operative position thereof to communicate said gaseous fuel chamber means with said nozzle means.

61. An internal combustion actuated portable tool as defined in claim 60 wherein said nozzle means comprises a plurality of nozzles spaced exteriorly annularly about said cylindrical chamber in axially spaced relation with respect to the open end thereof, each of said nozzles being positioned to direct a jet stream of gaseous fuel under pressure through said annular mixing chamber in a direction toward said annular inlet opening.

62. A pressurized gas actuated portable tool comprising a housing structure defining a handle for manual engagement, a cylindrical drive chamber and a drive track, a drive piston mounted in said cylindrical chamber for reciprocating movement through repetitive cycles each of which includes a drive stroke and a return stroke, a fastener driving element mounted in said drive track for movement with said drive piston through repetitive cycles each of which includes a drive stroke and a return stroke, fastener magazine means for containing a supply of fasteners and feeding successive fasteners into said drive track for movement outwardly thereof during successive drive strokes of said fastener driving element, manually controlled means for enabling a pressurized gas to be applied within said cylindrical drive chamber to said drive piston for effecting successive drive strokes of said drive piston, and piston return means for effecting successive return strokes of said drive piston, said piston return means comprising resilient bumper means disposed within said cylindrical drive chamber for engagement by said drive piston to define the position at which said drive piston reaches the end of a drive stroke and begins a return stroke and return stroke spring means mounted in said cylindrical drive chamber so as to be free of stress by the movement of said drive piston through a predetermined initial portion of each drive stroke thereof and to be progressively stressed by the movement of said drive piston through the remaining portion of each drive stroke following said predetermined initial portion so that with the pressure of the pressurized gas dissipated at the end of each drive stroke the energy of the stressed return stroke spring means is operable to initiate a return stroke of said drive piston and to operatively move said drive piston through an initial portion of the return stroke such that the movement imparted to said drive piston during the initial portion of the return stroke is sufficient to enable the drive piston to complete the return stroke thereof.

63. A pressurized gas actuated portable tool as defined in claim 62 wherein said return stroke spring means includes a sleeve member mounted within said cylindrical chamber adjacent said bumper means for movement between inoperative and operative positions and a coil spring disposed in surrounding relation with said bumper means, said sleeve member having means defining a piston engaging surface facing away from said bumper means and means defining a shoulder facing toward said bumper means, said coil spring having one end disposed in operative engagement with said shoulder and an opposite end disposed in operative engagement with said housing structure.

64. A pressurized gas actuated portable tool as defined in claim 63 wherein said sleeve member includes an end portion extending from said piston engaging surface in a direction away from said bumper means, said end portion having a cylindrical interior periphery of a diameter size generally equal to the diameter size of said cylindrical drive chamber and an axial dimension of an extent sufficient to receive the periphery of said drive piston when said drive piston is in operative engagement with said piston engaging surface.

65. An internal combustion actuated portable tool comprising a housing assembly including a main body portion having means defining a cylindrical drive chamber therein and a handle portion extending from said main body portion for enabling a user to manually move the housing assembly in portable fashion, a drive piston slidably sealingly mounted in said cylindrical drive chamber for movement through repetitive cycles each of which includes a drive stroke and a return stroke, combustion chamber means operatively associated with said cylindrical drive chamber within the main body portion of said housing assembly, means defining an annular mixing chamber within said housing assembly in a position adjacent said combustion chamber means and in surrounding relation with said cylindrical drive chamber, fresh air inlet means communicating with said mixing chamber means within said housing assembly, main valve means moveable between (1) an open position wherein said combustion chamber means is open at a position of adjacent communication with said mixing chamber means and at a spaced position of communication with the atmosphere and (2) a closed position wherein said combustion chamber means is closed from communication with said annular mixing chamber and the atmosphere, a plurality of nozzles spaced exteriorly annularly about said cylindrical drive chamber for directing a predetermined charge of fuel under pressure into said annular mixing chamber in a plurality of gaseous jet stream formations with said combustion chamber means open so that the jet stream formations are operable (1) to cause fresh air from said fresh air inlet means to be entrained and mixed with the charge of fuel forming the jet stream formations and (2) to cause the jet stream formation of gaseous fuel mixed with entrained air to flow from said annular mixing chamber into the open combustion chamber means and move sufficient residual gas in said combustion chamber means therethrough and into the atmosphere to fill the combustion chamber means with a charge of combustible gases in the form of an air-fuel mixture, and means operable in response to a manual actuating procedure for igniting said charge of combustible gases within the said combustion chamber means so that the subsequent burning thereof creates an elevated pressure condition within said combustion chamber means with said main valve means in the closed position thereof such that communication of the elevated pressure with said drive piston causes the same to be moved through a drive stroke.

66. An internal combustion actuated portable tool as defined in claim 65 wherein said main valve means includes an annular structure having a first end portion carrying said plurality of nozzles, a central portion extending axially from said first end portion and a second end portion extending axially from said central portion forming an exterior peripheral part of said combustion chamber means, said annular mixing chamber defining means including an interior peripheral surface on the central portion of said annular structure defining the exterior periphery of said annular mixing chamber.

67. A pressurized gas actuated portable tool comprising a housing assembly including a workpiece engaging portion having means defining a fastener drive track therein, a main body portion adjacent said workpiece engaging portion defining an acceptable housing profile and having means defining a cylindrical drive chamber therein and a handle portion extending transversely from said main body portion for enabling a user to manually move the housing assembly in portable fashion, a drive piston slidably sealingly mounted in said cylindrical drive chamber for movement through repetitive cycles each of which includes a drive stroke and a return stroke, a fastener driving element operatively connected with said piston and mounted in said fastener drive track for movement therein through a drive stroke in response to the drive stroke of said piston and a return stroke in response to the return stroke of said piston, magazine means carried by said housing means for containing a supply of fasteners and feeding successive leading fasteners of the supply into said fastener drive track to be driven therefrom by said fastener driving element during the drive stroke thereof, main valve means movable from an inoperative position into an operative position for enabling a pressurized gas to be applied to said drive piston to move the same through a drive stroke, actuating valve means mounted in said housing assembly for movement in response to a predetermined actuating procedure from (1) an inoperative position into (2) an operative position, spring means acting between said actuating valve means and said housing assembly for resiliently biasing said actuating valve means into the operative position thereof, an actuating valve moving member mounted for movement (1) from (A) an actuating valve retaining position wherein said actuating valve means is retained thereby in the inoperative position thereof against the bias of said spring means into (B) an actuating valve releasing position wherein said actuating valve means is released so as to be biased by said spring means into the operating position thereof and (2) from (A) said actuating valve releasing position into (B) an actuating valve engaging position and (3) from (A) said actuating valve engaging position into (B) said actuating valve retaining position in motion transmitting relation with said actuating valve means so as to move the actuating valve means from the operative position thereof into the inoperative position thereof against the bias of said spring means, and means operable in response to a predetermined manual actuating procedure for moving said actuating valve moving member from the actuating valve retaining position thereof to the actuating valve releasing position thereof.

68. A pressurized gas actuated portable tool as defined in claim 67 wherein said actuating procedure responsive means includes trigger means mounted on said housing assembly for digital movement by a user grasping said handle portion from an inoperative position into an operative position, contact trip means mounted adjacent said workpiece engaging portion for movement from an inoperative position into an operative position in response to the engagement of said workpiece engaging portion with a workpiece, and said predetermined actuating procedure comprises (1) a movement of said contact trip means into the operative position thereof and (2) a digital movement of said trigger means from the inoperative position thereof into the operative position thereof.

69. A pressurized gas actuated portable tool as defined in claim 68 wherein said actuating valve moving member, said contact trip means and said trigger means have means operatively associated therewith for (1) enabling said actuating valve moving member to be moved from the actuating valve retaining position thereof into the actuating valve releasing position thereof by the movement of said trigger means into the operative position thereof after said contact trip means has been moved into the operative position thereof and (2) preventing said actuating valve moving member from being moved from the actuating valve retaining position thereof into the actuating valve releasing position thereof by the movement of said trigger means from the inoperative position thereof into the operative position thereof before said contact trip means has been moved into the operative position thereof.

* * * * *